US007377223B2

(12) United States Patent
Toupin et al.

(10) Patent No.: US 7,377,223 B2
(45) Date of Patent: May 27, 2008

(54) PERSONAL WATERCRAFT STORAGE BIN

(75) Inventors: Pascal Toupin, Sherbrooke (CA); Martin Bernier, St-Francois Xavier de Brompton (CA)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 11/466,017

(22) Filed: Aug. 21, 2006

(65) Prior Publication Data

US 2008/0041287 A1 Feb. 21, 2008

(51) Int. Cl.
*B63B 35/73* (2006.01)
*B65D 43/16* (2006.01)
*B65D 43/22* (2006.01)

(52) U.S. Cl. ..... 114/55.5; 114/55.53; 114/343; 220/315; 220/324; 220/810; 220/378

(58) Field of Classification Search ..... 114/55.5, 114/55.53, 55.57, 343, 364
See application file for complete search history.

(56) References Cited

U.S. PATENT DOCUMENTS 5,097,789 A * 3/1992 Oka ..... 114/363
5,669,326 A 9/1997 Ikeda
6,276,290 B1 8/2001 Yamada et al.
6,668,742 B2 12/2003 Nadeau et al.
6,959,660 B1 * 11/2005 Packebush ..... 114/55.53
2001/0000052 A1 3/2001 Yamada et al.
2003/0061975 A1 * 4/2003 Nadeau et al. ..... 114/55.53
2003/0131776 A1 * 7/2003 Nakajima et al. ..... 114/55.51

* cited by examiner

*Primary Examiner*—Sherman Basinger
(74) *Attorney, Agent, or Firm*—Osler, Hoskin & Harcourt LLP

(57) ABSTRACT

A personal watercraft has a hull, a deck disposed on the hull, a bin, and hood. The hood is operatively connected to the deck and is movable between an open position providing access to the storage bin and a closed position preventing access to the storage bin. An opening having a contour is provided in the deck forwardly of the watercraft's steering handles. The storage bin is disposed in the opening. The storage bin has a container disposed in the opening and a lid operatively connected to the container. The lid is movable between an open position providing access to an interior of the container and a closed position preventing access to the interior of the container. A storage bin to be used in combination with a personal watercraft is also disclosed.

25 Claims, 23 Drawing Sheets

PERSONAL WATERCRAFT STORAGE BIN

FIELD OF THE INVENTION

The present invention relates to a storage bin for personal watercraft and a personal watercraft incorporating a storage bin.

BACKGROUND OF THE INVENTION

Most personal watercraft are provided with one or more storage bins to store various items. Some items are required by law such as, but not limited to, a watertight flashlight, flares, a whistle, a paddle, an anchor, a bailer, a rope, watercraft registration documents, an/or a fire extinguisher (it should be understood that these will vary depending on the jurisdiction). Others are items that the users of the watercraft may want to bring with them, such as towels, a cooler, or tools. Depending on the watercraft, a storage bin may be located under the seat or under the hood or both. A glove box is often also provided to store smaller items. One of the challenges faced by watercraft manufacturers is to discourage water from entering the storage bins.

FIGS. 7 to 10 illustrate a prior art personal watercraft storage bin and hood arrangement. In this arrangement, a personal watercraft 200 has a first storage bin 202, a second storage bin in the form of storage tray 204, and a hood 206 hinged to the deck 208. The first storage bin 202 is fixedly connected to the deck 208 of the watercraft 200 below an access opening in the deck 208. The storage tray 204 is disposed in the opening above the first storage bin 202 and rests on the edge of the opening (see FIG. 9). The storage tray 204 can be removed from the watercraft 200. The handle 210 provided in the storage tray 204 allows the storage tray 204 to easily be carried. The hood 206 is movable between an open position (FIG. 10) providing access to the storage bins 202, 204, and a closed position (FIGS. 7 and 8) preventing access to the storage bins 202, 204. As best seen in FIG. 9, a trim element 212 having three sealing ridges 214 is disposed around the opening. A pair of deformable seals 216 are connected to ridges 218 on an inner surface of the hood 206. When the hood 206 is in its closed position, the sealing ridges 214 engage the deformable seals 216 to provide a watertight seal which discourages water from entering the storage bins 202, 204. Additional details concerning an arrangement of this type can be found in U.S. Pat. No. 6,668,742 issued on Dec. 30, 2003.

Although the arrangement illustrated in FIGS. 7 to 10 satisfactorily discourages water from entering the storage bins 202, 204, providing the seals 216 on the hood 206 has some disadvantages. One disadvantage is that the inner surface of the hood 206 needs to be shaped to add the ridges 218 that will permit the seals 216 to press onto the sealing ridges 214. This increases the complexity of the hood 206. Also, care must be taken when fastening the hood 206 to the deck 208 to make sure that the seals 216 align with the sealing ridges 214 when the hood 206 is in its closed position.

Although the removable storage tray 204 allows items stored therein to be easily carried by the user away from the watercraft 202, once the storage tray 204 is removed from the watercraft 200, the items stored therein are exposed to the elements. If, for example, the storage tray 204 is carried on a beach, sand can go inside the storage tray 204.

Therefore, there is a need for a different arrangement for discouraging water from entering a storage bin to be used in a personal watercraft.

There is also a need for a storage bin for a personal watercraft which can be removed from the watercraft while maintaining the items stored therein protected from the elements.

Embodiments of the present invention address at least one of the above-mentioned needs or problems, but do not necessarily address all of them.

STATEMENT OF THE INVENTION

One aspect of the invention provides a storage bin having a container and a lid operatively connected to the container.

Another aspect of the invention provides a personal watercraft having such a storage bin.

In yet another aspect, the invention provides a personal watercraft having a hull, and a deck disposed on the hull. The hull and the deck define an engine compartment. A propulsion system is connected to the hull for propelling the watercraft. An engine is disposed in the engine compartment for powering the propulsion system. Steering handles are disposed at least partially forwardly of the seat for steering the watercraft. An opening is provided in the deck forwardly of the steering handles. The opening has a contour. The personal watercraft also has a storage bin. The storage bin is disposed in the opening. The storage bin has a container disposed in the opening and a lid operatively connected to the container. The lid is movable between an open position providing access to an interior of the container and a closed position preventing access to the interior of the container. A hood of the personal watercraft is operatively connected to the deck and is movable between an open position providing access to the storage bin and a closed position preventing access to the storage bin.

In a further aspect, a seat is disposed on the deck.

In an additional aspect, the lid is hinged to the container.

In a further aspect, the storage bin has a handle disposed on the lid.

In an additional aspect, the storage bin is removable from the opening.

In a further aspect, the storage bin is latched to the deck.

In an additional aspect, the container has a lip. The lip rests on the contour of the opening.

In a further aspect, the contour of the opening is raised relative to portions of the deck adjacent to the contour.

In an additional aspect, the personal watercraft has a first seal disposed between the container and the contour of the opening.

In a further aspect, the first seal is attached to the lip.

In an additional aspect, the personal watercraft has a second seal disposed between the lip and the lid when the lid is in the closed position.

In a further aspect, the personal watercraft has a seal disposed between the container and the lid when the lid is in the closed position.

In an additional aspect, the personal watercraft has at least one lock for locking the lid in the closed position.

In a further aspect, the hood is hinged to the deck.

In another aspect, the invention provides a storage bin for a personal watercraft having a container having a plurality of sides, a bottom, and an open end opposite the bottom. A lip extends outwardly from at least a portion of the sides. The lip is disposed near the open end. A first seal is attached to the container. The first seal is disposed below the lip. A lid is operatively connected to the container. The lid is movable between an open position providing access to an interior of the container via the open end and a closed position preventing access to the interior of the container. A second seal is disposed between the lip and the lid when the lid is in the closed position.

In an additional aspect, the lid is hinged to the container.

In a further aspect, the storage bin has a handle disposed on the lid.

In an additional aspect, the storage bin has at least one lock provided for locking the lid in the closed position.

In a further aspect, the first seal is attached to the lip, and the first seal is disposed under the lip In an additional aspect, the second seal is attached to the lid.

In a further aspect, the lid has at least one tongue extending therefrom. The at least one lock has a hinged portion having an opening therein. The hinged portion is movable between a locked position and an unlocked position, such that when the hinged portion is in the locked position, the at least one tongue extends inside the opening of the hinged portion to prevent the lid from being moved to the open position.

In an additional aspect, the hinged portion of the at least one lock is hinged to the lip via a living hinge.

In a further aspect, the plurality of sides is four sides. The lid is hinged to one side of the container. The at least one lock is four locks. Two of the locks are disposed on a side of the container opposite the side to which the lid is hinged. One of the locks is disposed on each of the remaining two sides.

In an additional aspect, the storage bin has spark plug support disposed on a side of the lid facing the interior of the container when the lid is in the closed position.

In a further aspect, the storage bin has a receptacle disposed inside the container.

Embodiments of the present invention each have at least one of the above-mentioned aspects, but do not necessarily have all of them.

Additional and/or alternative features, aspects, and advantages of the embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE INVENTION

Figure 1:
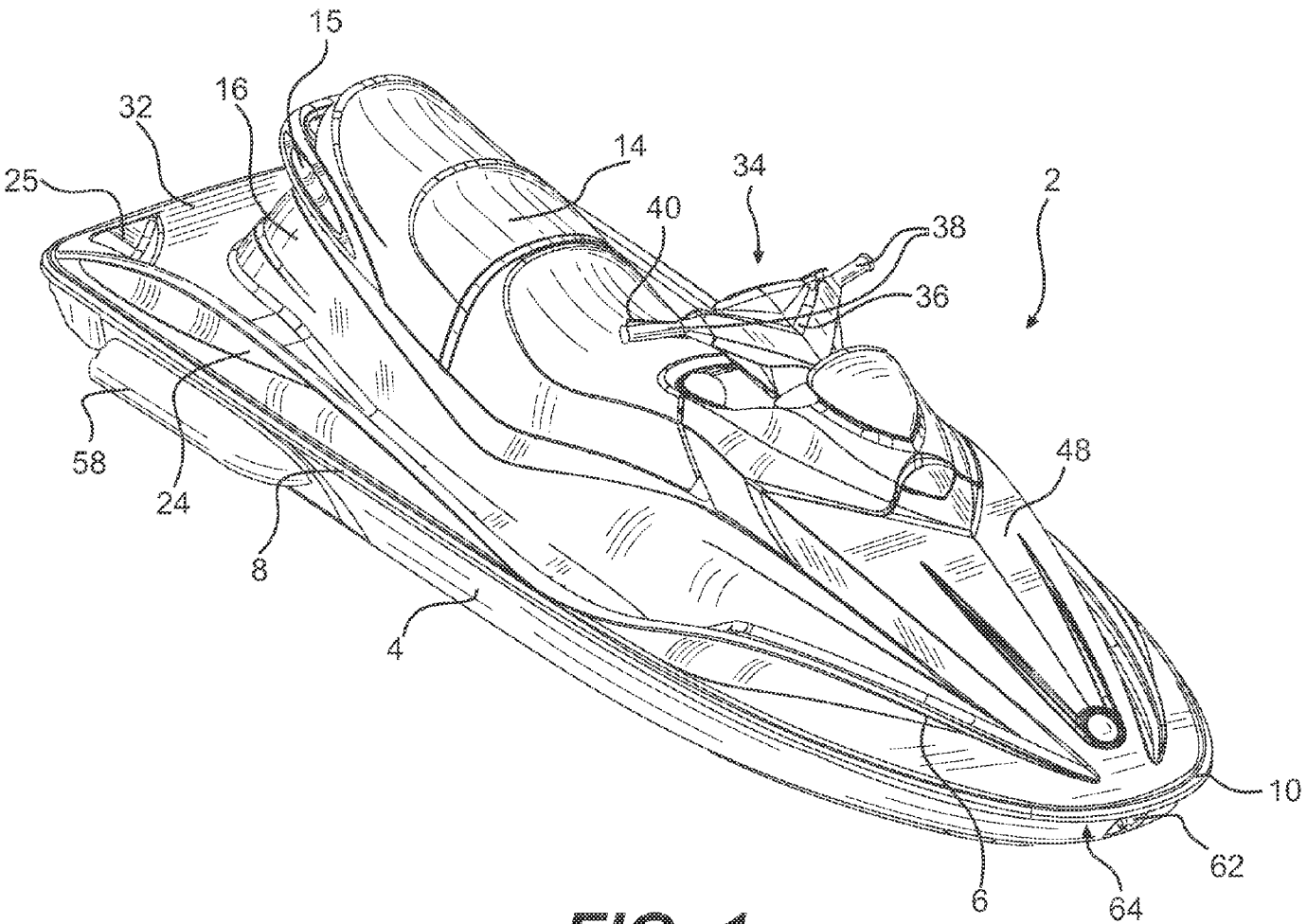
FIG. 1 is a perspective view, taken from a front, right side, of a personal watercraft in accordance with the present invention.

FIGS. 1 to 6 illustrate a personal watercraft 2 in accordance with the present invention. The personal watercraft 2 is made of two main parts. These parts are the hull 4 and the deck 6, which is disposed on the hull 4. The hull 4 buoyantly supports the watercraft 2 in the water. The deck 6 is designed to accommodate a rider and, in some watercraft, one or more passengers. The hull 4 and deck 6 are joined together at the bond line 8 by an adhesive. Rivets or other fasteners may also be used to join the hull 4 to the deck 6. A bumper 10 generally covers the bond line 8, which helps to prevent damage to the outer surface of the watercraft 2 when the watercraft 2 is docked. The volume created between the hull 4 and the deck 6 is known as the engine compartment. The engine compartment accommodates the engine 12 (schematically illustrated in FIG. 3) as well as the muffler, exhaust pipe, gas tank, electrical system (battery, electronic control unit . . . ), air box, storage bins (such as storage bin 50 schematically illustrated in FIG. 4) and other elements required by or desired for the watercraft 2.

The deck 6 has a centrally positioned straddle-type seat 14 placed on top of a pedestal 16 to accommodate a rider in a straddling position. A grab handle 15 is provided between the pedestal 16 and the straddle-type seat 14 at the rear of the straddle-type seat 14 to provide a handle onto which a passenger may hold on. The seat 14 is preferably removably attached to the pedestal 16 by a hook and tongue assembly (not shown) at the front of the seat 14 and by a latch assembly (not shown) at the rear of the seat 14, or by any other known attachment mechanism. The seat 14 covers an engine access opening (not shown), defined by a top portion of the pedestal 16, which provides access to the engine 12. A glove box 23 is provided in front of the straddle type seat 14.

Figure 6:
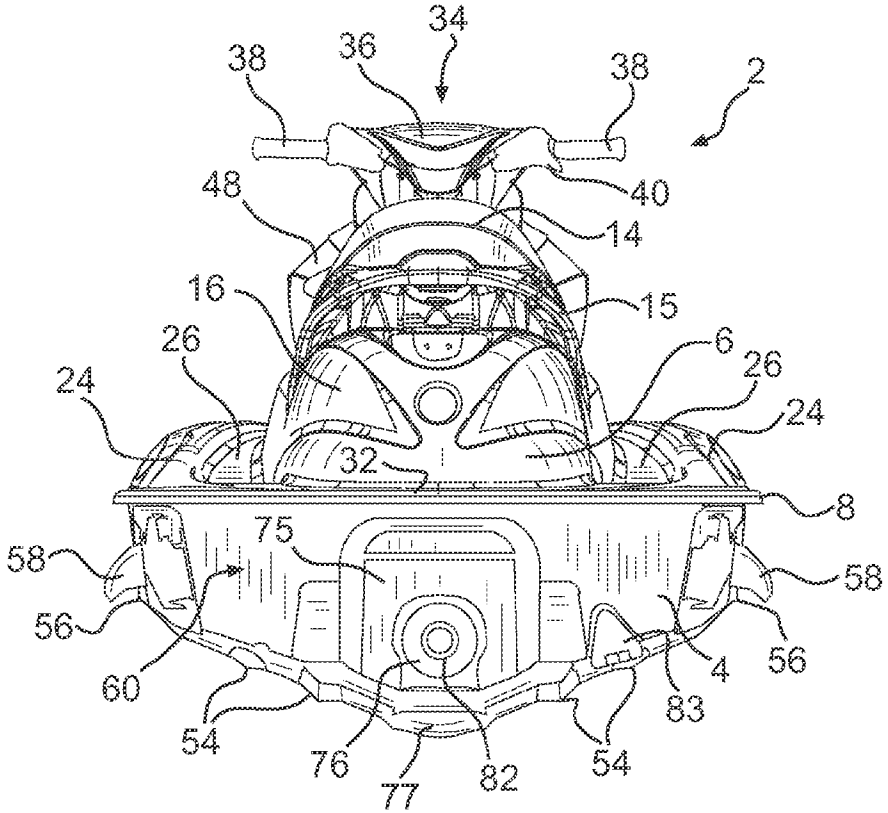
FIG. 6 is a rear elevation view of the personal watercraft of FIG. 1.
Figure 7:
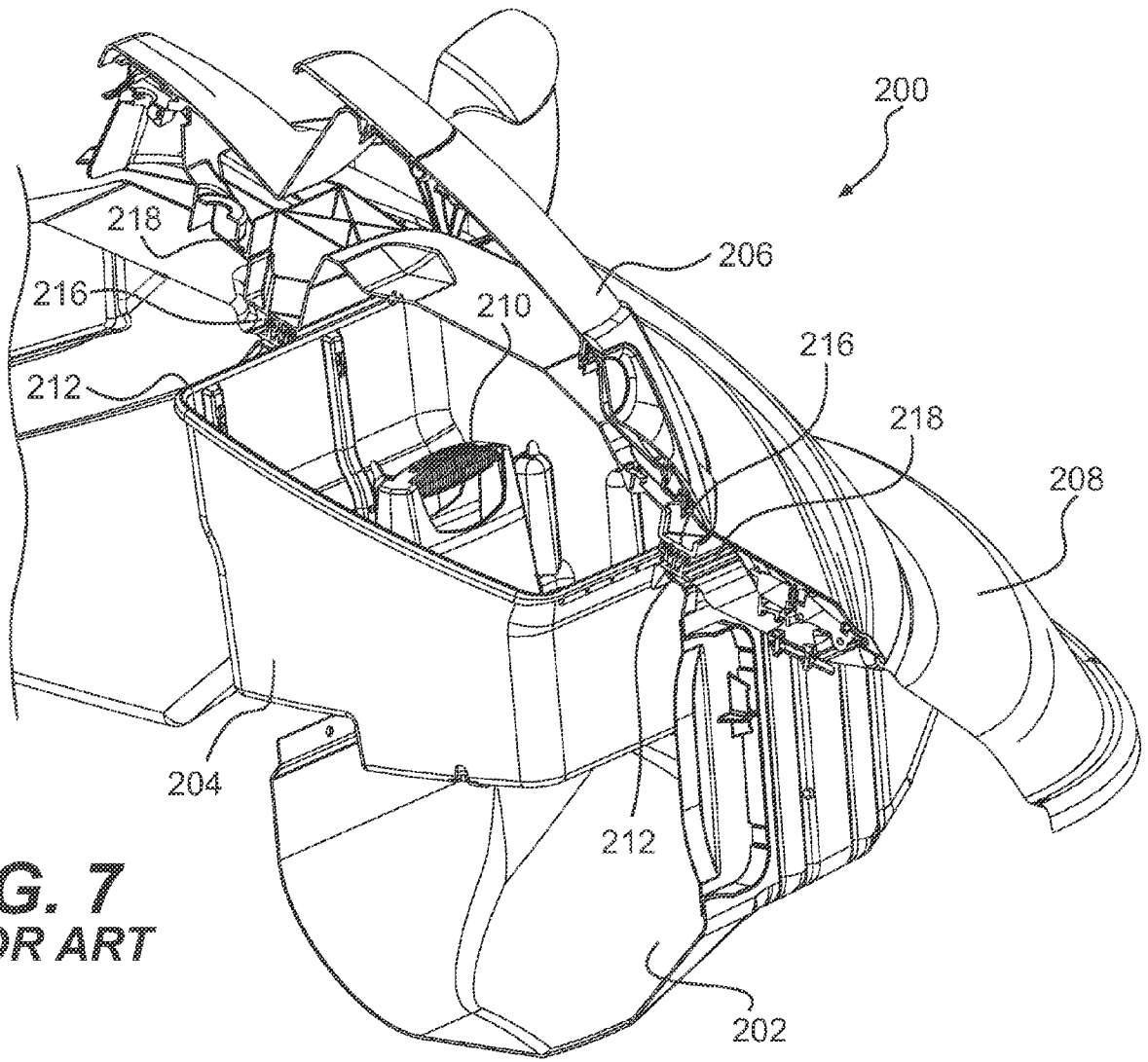
FIG. 7 PRIOR ART
FIG. 7 is a partial cross-sectional view, taken from a front, right side, of a front portion of a personal watercraft having a prior art storage bin and hood arrangement with the hood in a closed position.
Figure 8:
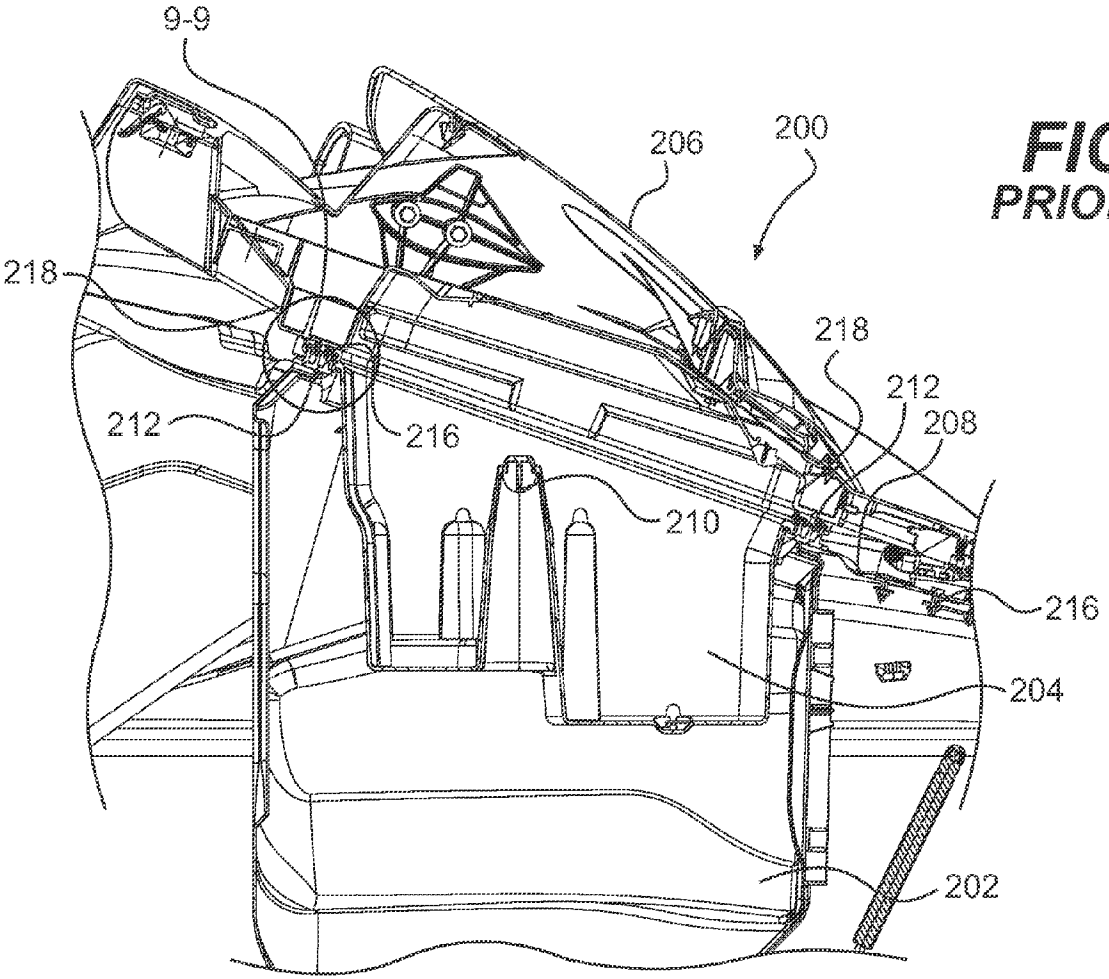
FIG. 8 PRIOR ART
FIG. 8 is a cross-sectional view, taken from a right side, of the front portion of the personal watercraft of FIG. 7.
Figure 9:
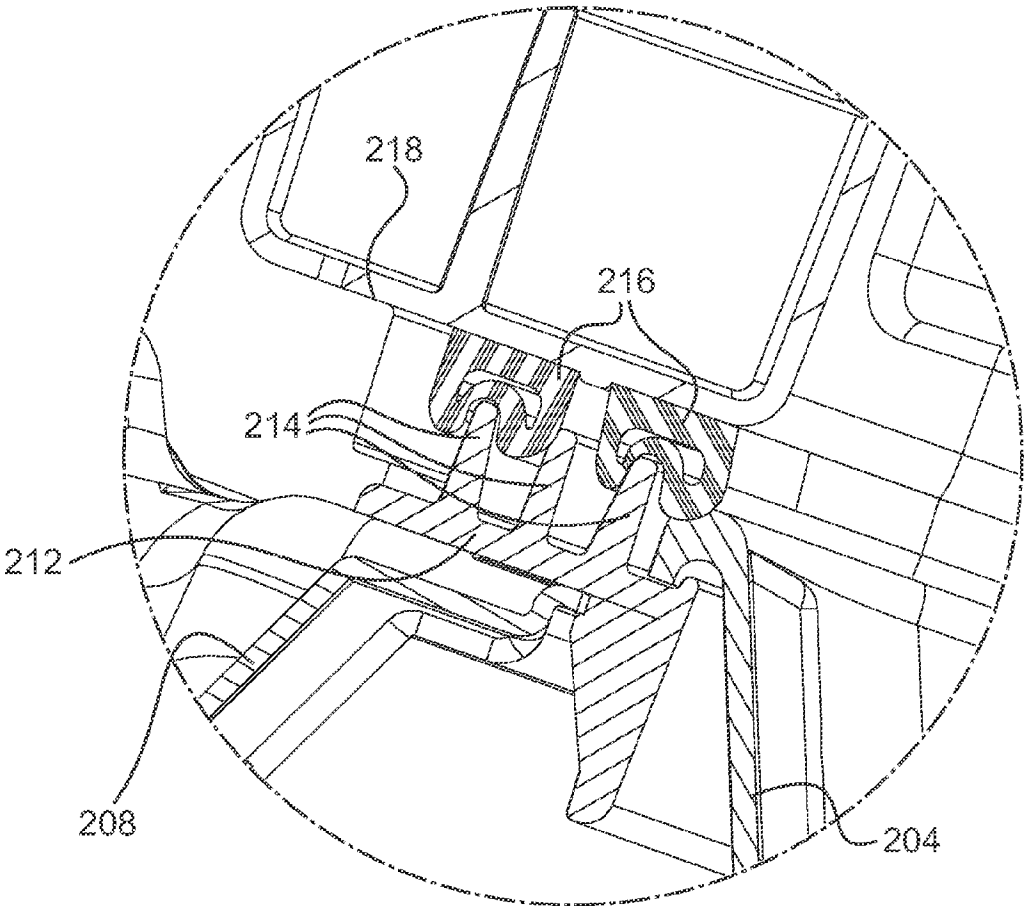
FIG. 9 PRIOR ART
FIG. 9 is a close-up view of portion 9-9 of FIG. 8 showing the layout of the seals disposed between the storage bin and the hood.
Figure 10:
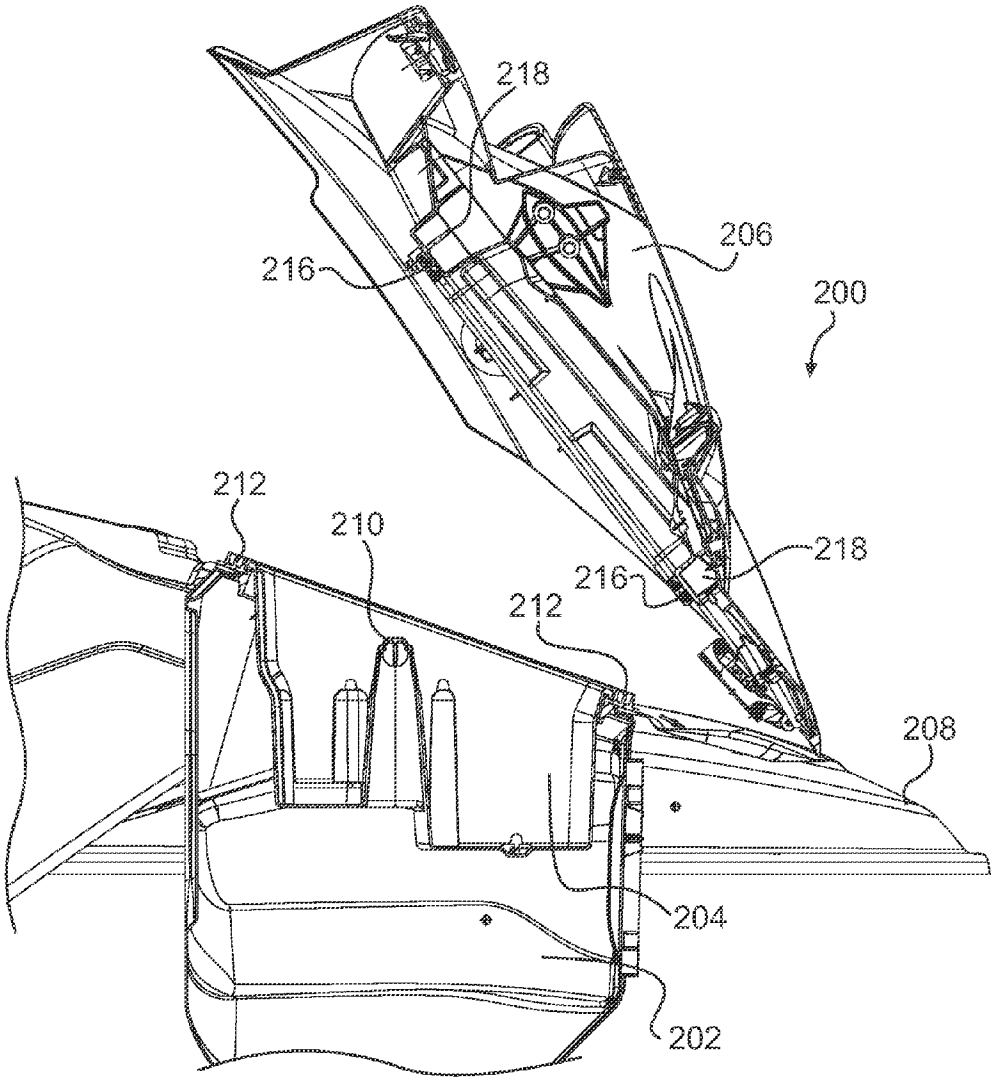
FIG. 10 PRIOR ART
FIG. 10 is a cross-sectional view, taken from a right side, of the front portion of personal watercraft of FIG. 7 with the hood in an opened position.

As best seen in FIG. 6, the watercraft 2 has a pair of generally upwardly extending walls, known as gunwales or gunnels 24, located on either side of the watercraft 2. The gunnels 24 help to discourage the entry of water in the watercraft 2, provide lateral support for the rider's feet, and also provide buoyancy when turning the watercraft 2, since personal watercraft roll slightly when turning. Towards the rear of the watercraft 2, the gunnels 24 extend inwardly to act as heel rests 25. Heel rests 25 allow a passenger riding the watercraft 2 facing the towards the rear, to spot a water-skier for example, to place his heels on the heel rests 25, thereby providing him with a more stable riding position. It should be noted that heel rests 25 could also be separate from the gunnels 24.

Located on either side of the seat 14, between the pedestal 16 and the gunnels 24, are a pair of footrests 26. The footrests 26 are designed to accommodate a rider's feet in various riding positions. To this effect, the forward portions 28 of the footrests 26 are angled such that the front portions 28*a* of the forward portions 28 are higher than the rear portions 28*b* of the forward portions 28. The remaining portions of the footrests 26 are generally horizontal. The footrests 26 may be covered by carpeting made of a rubber-type material to provide additional comfort and feet traction for the rider. A reboarding platform 32 is provided at the rear of the watercraft 2 to allow the rider or a passenger to easily reboard the watercraft 2 from the water. Carpeting may also cover the reboarding platform 32. A retractable ladder may be affixed to the transom 60 to facilitate boarding the watercraft 2 from the water onto the reboarding platform 32.

Figure 2:
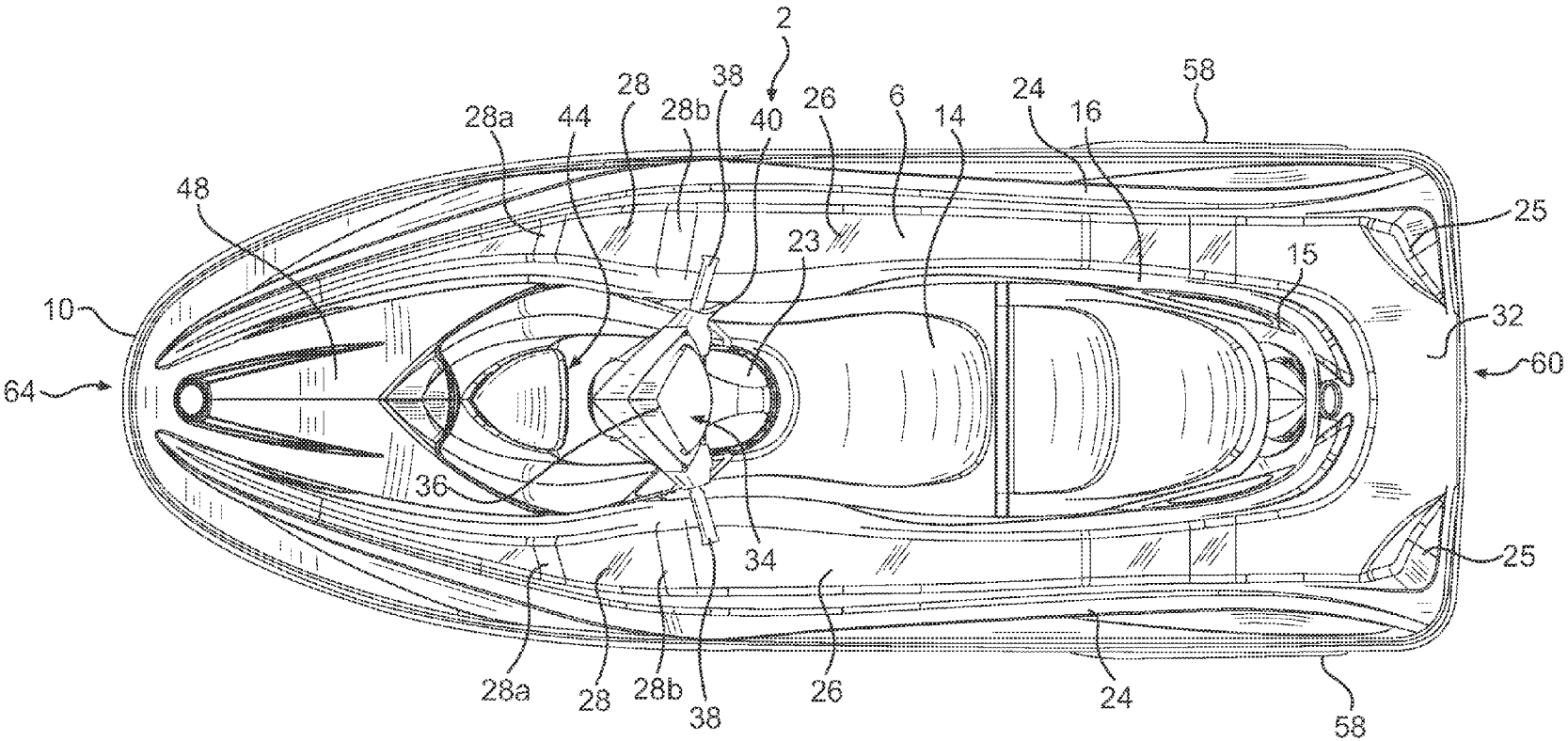
FIG. 2 is a top view of the personal watercraft of FIG. 1.
Figure 3:
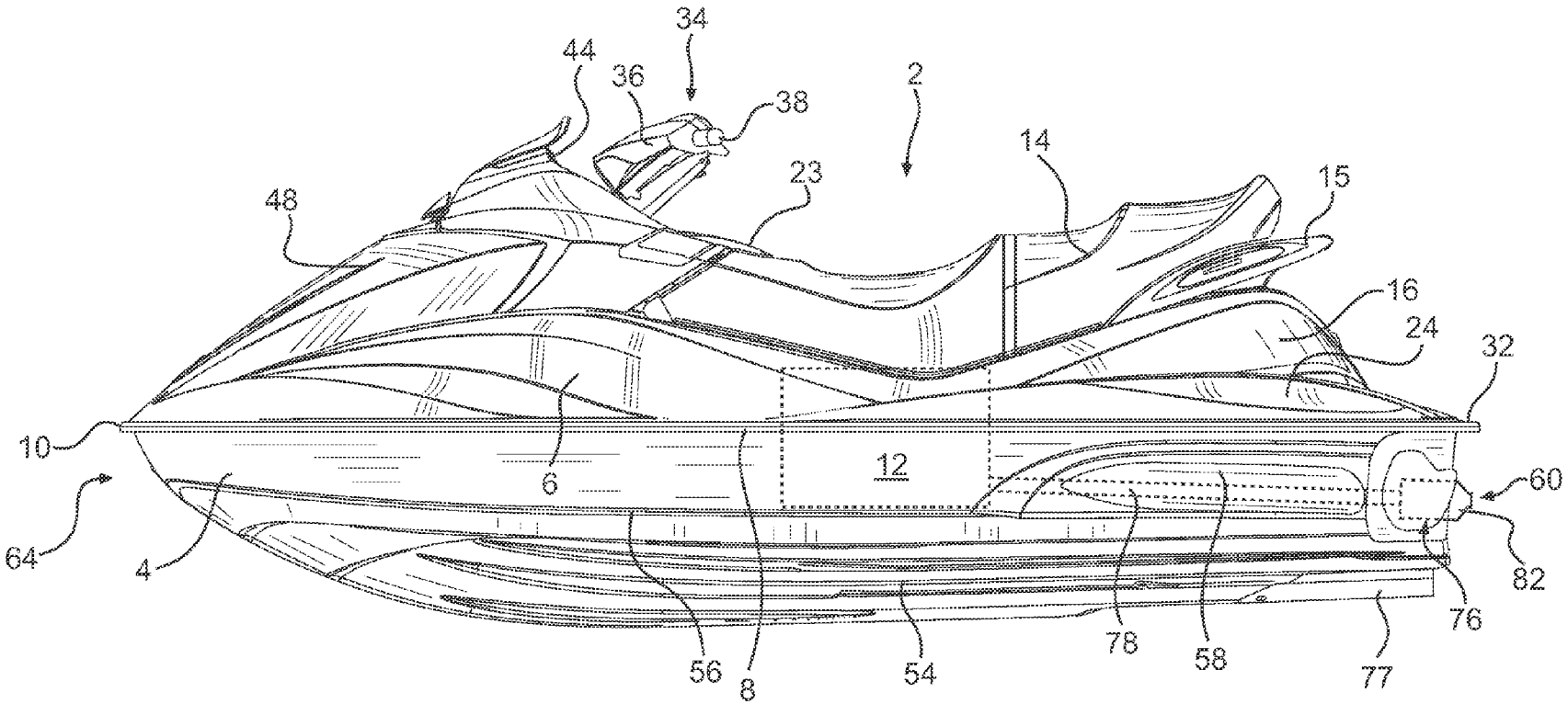
FIG. 3 is a left side elevation view of the personal watercraft of FIG. 1.
Figure 4:
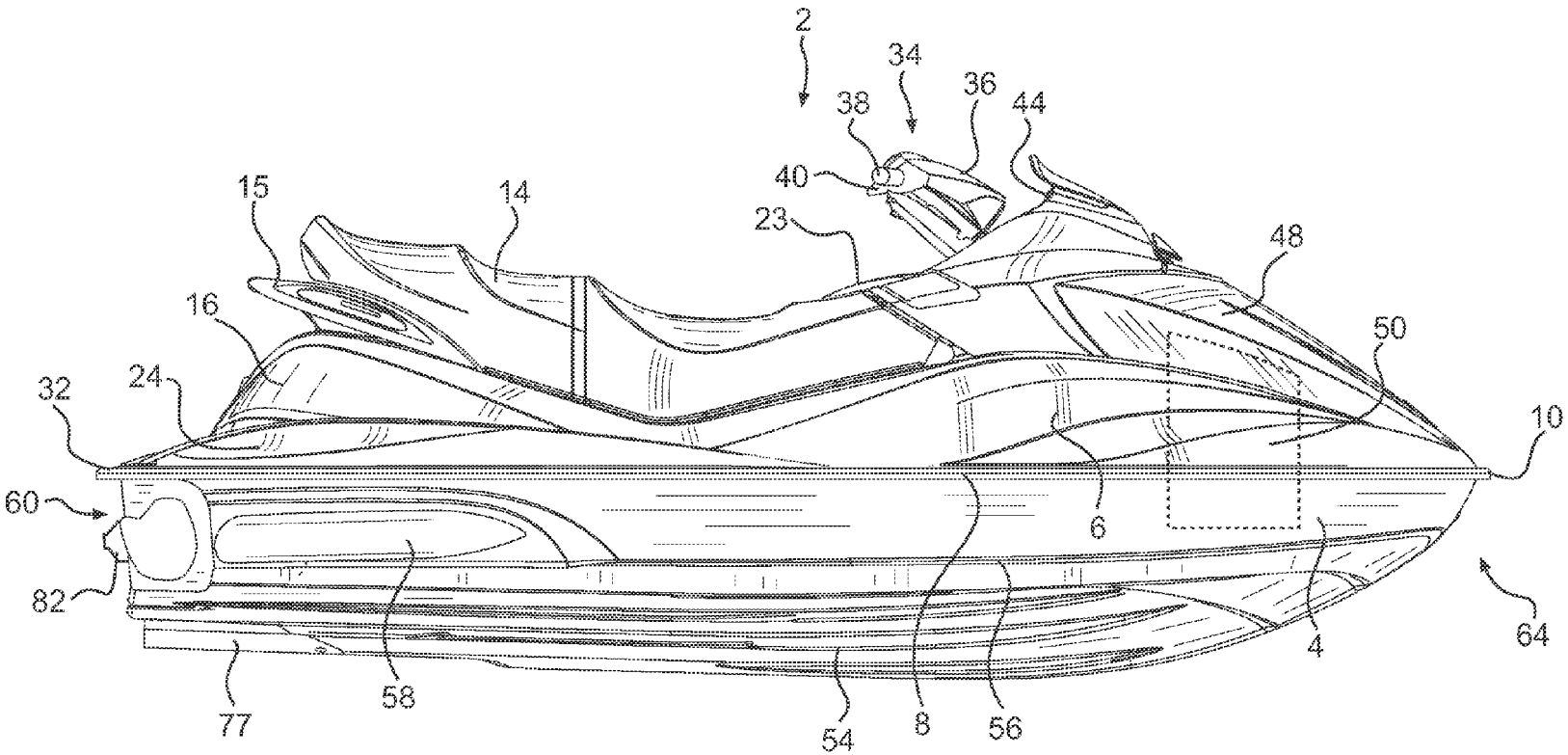
FIG. 4 is a right side elevation view of the personal watercraft of FIG. 1.
Figure 5:
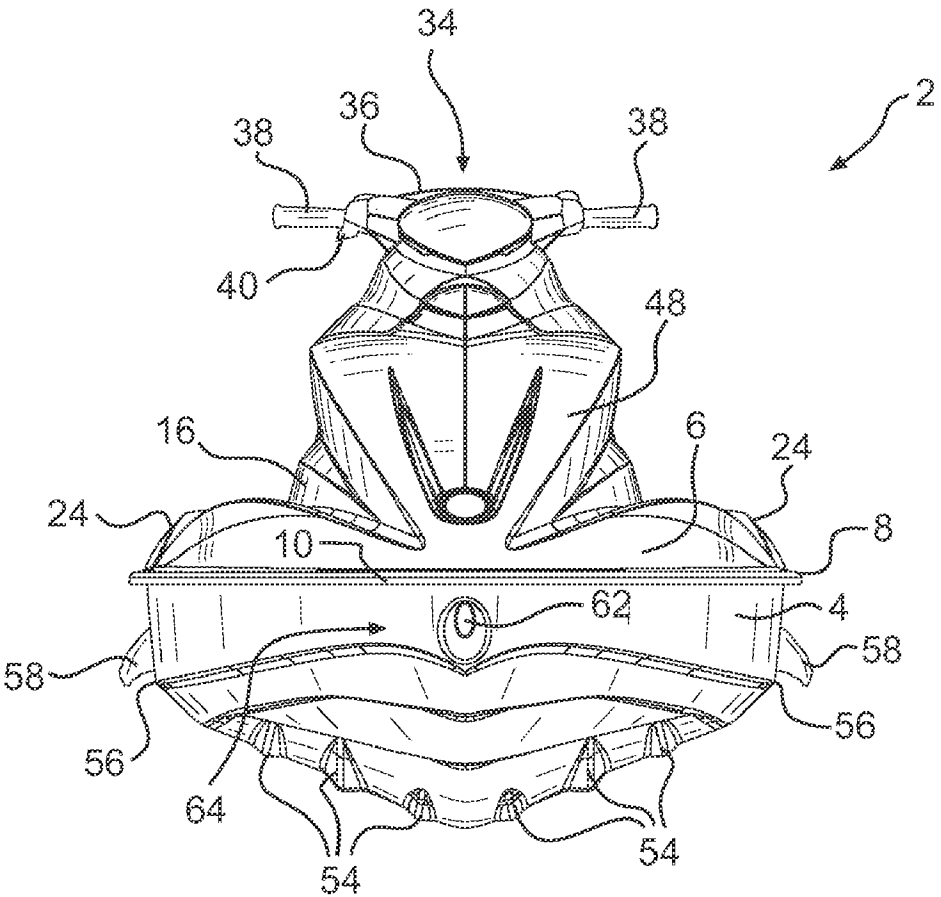
FIG. 5 is a front elevation view of the personal watercraft of FIG. 1.

As best seen in FIGS. 2 to 4, a helm assembly 34 is positioned forwardly of the straddle-type seat 14. The helm assembly 34 has a central helm portion 36 that may be padded, and a pair of steering handles 38. One of the steering handles 38 is provided with a throttle lever 40 allowing the rider to control the speed of the watercraft 2. The central helm portion 36 may also have buttons that allow the rider to modify what is displayed (speed, engine rpm, time . . . ) on the display cluster 44 located forwardly of the helm assembly 34 or to change a condition of the watercraft 2 such as trim (the pitch of the watercraft). The helm assembly 34 may also be provided with a key receiving post, preferably located near a center of the central helm portion 36. The key receiving post is adapted to receive a key attached to a lanyard so as to allow starting of the watercraft 2. It should be noted that the key receiving post may be placed in any other suitable location on the watercraft 2.

The watercraft 2 is provided with a hood 48 located forwardly of the helm assembly 34. A hinge 52 (FIG. 11) is attached between a forward portion of the hood 48 and the deck 6 to allow hood 48 to move between an open position (shown in FIG. 11) providing access to the storage bin 50 and a closed position (shown in FIG. 4) preventing access to the storage bin 50, as will be discussed in greater detail below. A latch 53 (FIG. 11) located at a rearward portion of hood 48 locks the hood 48 into a closed position.

The hull 4 is provided with a combination of strakes 54 and chines 56. A strake 54 is a protruding portion of the hull 4. A chine 56 is the vertex formed where two surfaces of the hull 4 meet. It is this combination of strakes 54 and chines 56 that will give the watercraft 2 its riding and handling characteristics.

Sponsons 58 are located on either of the hull 4 near the transom 60. The sponsons 58 have an arcuate undersurface, which give the watercraft 2 both lift while in motion and improved turning characteristics.

A hook 62 is located at the bow 64 of the watercraft 2. The hook 52 is used to attach the watercraft 2 to a dock when it is not in use.

The watercraft 2 is generally propelled by a jet pump 76. It is contemplated that other types of propulsion systems, such as propellers, could also be used. The jet pump 76 pressurizes water and accelerates it to create thrust. The water is first scooped from under the hull 4 through an inlet grate (not shown). The inlet grate prevents large rocks, weeds, and other debris from entering the jet pump 76 since they may damage it or negatively affect its performance. Water then flows through the water intake ramp (not shown). The top portion of the water intake ramp is preferably formed by hull 4 and the ride shoe (not shown) forms its bottom portion. Alternatively, the intake ramp may be a single piece to which the jet pump 76 attaches. In such cases, the intake ramp and the jet pump unit 76 are attached as a unit in a recess in the bottom of hull 4. From the intake ramp, water then enters the jet pump 76. The jet pump 76 is located in what is known as the tunnel 75. The tunnel 75 is opened towards the rear, and is defined at the front, sides, and top by the hull 4, and at the bottom by the ride plate 77. The ride plate 77 is the surface on which the watercraft 2 rides or planes. The jet pump 76 is made of two main parts: the impeller (not shown) and the stator (not shown). The impeller is coupled to the engine 12 by one or more shafts 78, such as a driveshaft and an impeller shaft. The rotation of the impeller pressurizes the water, which then moves over the stator that is made of a plurality of fixed stator blades (not shown). The role of the stator blades is to decrease the rotational motion of the water so that most of the energy imparted to the water is used for thrust, as opposed to swirling the water. Once the water leaves the jet pump 76, it goes through the pump nozzle (not shown). Since the pump nozzle's exit diameter is smaller than its entrance diameter, the water is accelerated further, thereby providing more thrust. A steering nozzle 82 is pivotally attached to the pump nozzle through a vertical pivot point. The steering nozzle 82 is operatively connected to the helm assembly 34 via a push-pull cable (not shown) such that when the helm assembly 34 is turned, the steering nozzle 82 pivots, redirecting the water coming from the pump nozzle, so as to steer the watercraft 2 in the desired direction. In some watercraft, the steering nozzle 82 may be gimbaled to allow it to move around a second horizontal pivot axis. The up and down movement of the steering nozzle 82 provided by this additional pivot axis is known as trim, and controls the pitch of the watercraft 2.

When the watercraft 2 is in movement, its speed is measured by a speed sensor 83 attached to the transom 60 of the watercraft 2. The speed sensor 83 has a paddle wheel which is turned by the flow of water passing by the watercraft, therefore the faster the watercraft 2 goes, the faster the paddle wheel turns. An electronic control unit (not shown) connected to the speed sensor 83 converts the rotational speed of the paddle wheel to the speed of the watercraft 2 in kilometers or miles per hour, depending on the rider's preference. The speed sensor 83 may also be placed in the ride plate 77 or any other suitable position. Other types of speed sensors, such as pitot tubes, could also be used.

Some watercraft 2 have the ability to move in a reverse direction. To do this a reverse gate (not shown) is used. The reverse gate is pivotally attached to the sidewalls of the tunnel 75, directly on the pump nozzle, or directly on the steering nozzle 82. To make the watercraft 2 move in a reverse direction, the rider pulls on a reverse handle (not shown) operatively connected to the reverse gate. The reverse gate then pivots in front of the steering nozzle 82 and redirects the water leaving the jet pump 76 towards the front of the watercraft 2, thereby thrusting the watercraft 2 rearwardly.

Turning now to FIGS. 11 to 17, it can be seen that the storage bin 50 is made of a container 100 and a lid 102, both of which are preferably made of plastic. The purpose of the lid 102 is to discourage water (or other things, such as sand, when the storage bin 50 is removed from the watercraft 2) from entering an interior of the container 100.

The lid 102 is hinged to the container 100 via a hinges 104 located on a front of the storage bin 50. It is contemplated that the hinges 104 could be located on another side of the storage bin 50 and that more or less hinges 104 could be provided. It is also contemplated that the lid 102 could be attached to the container 100 by using other means such as, but not limited to, fasteners or by having the container 100 and the lid 102 shaped such that the lid 102 can be manually pressed on the container 100 and be retained thereon by a press fit.

Figure 11:
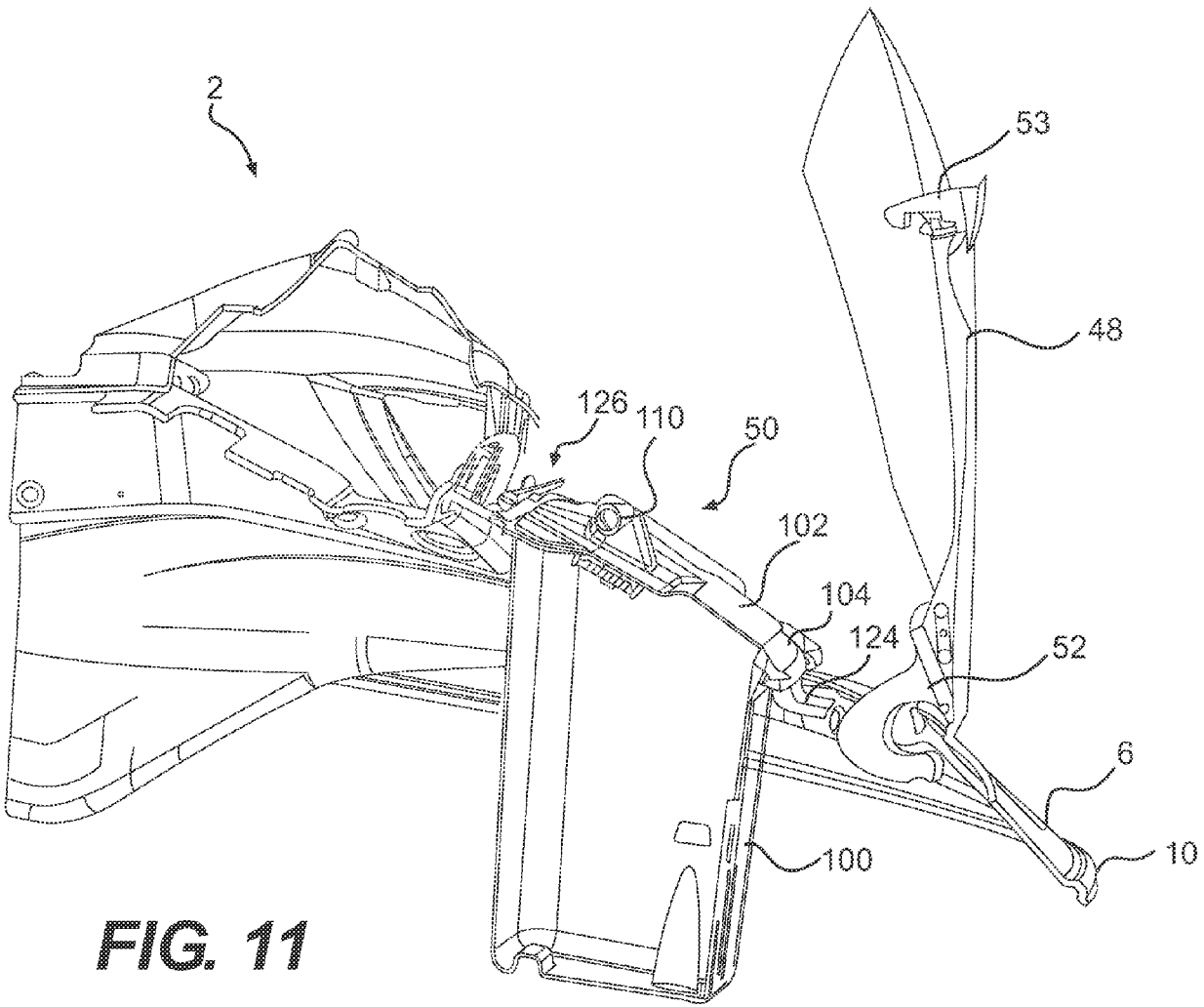
FIG. 11 is a cross-sectional view, taken from a right side, of a front portion of a personal watercraft having a storage bin in accordance with the present invention with the hood in an open position.
Figure 12:
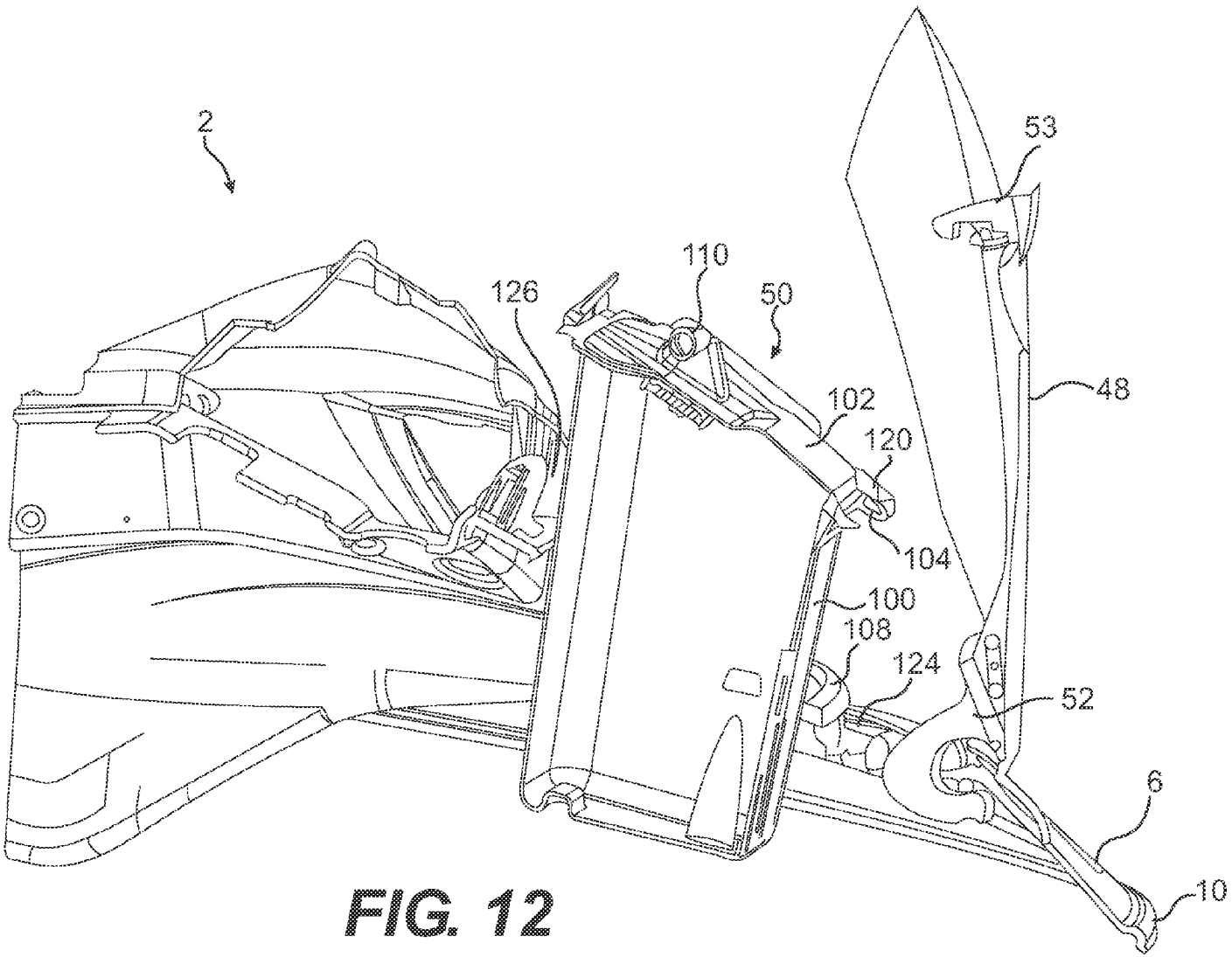
FIG. 12 is a cross-sectional view, taken from a right side, of the front portion of the personal watercraft of FIG. 11 with the hood in the open position and the storage bin partially removed from the opening in the deck of the personal watercraft.
Figure 13:
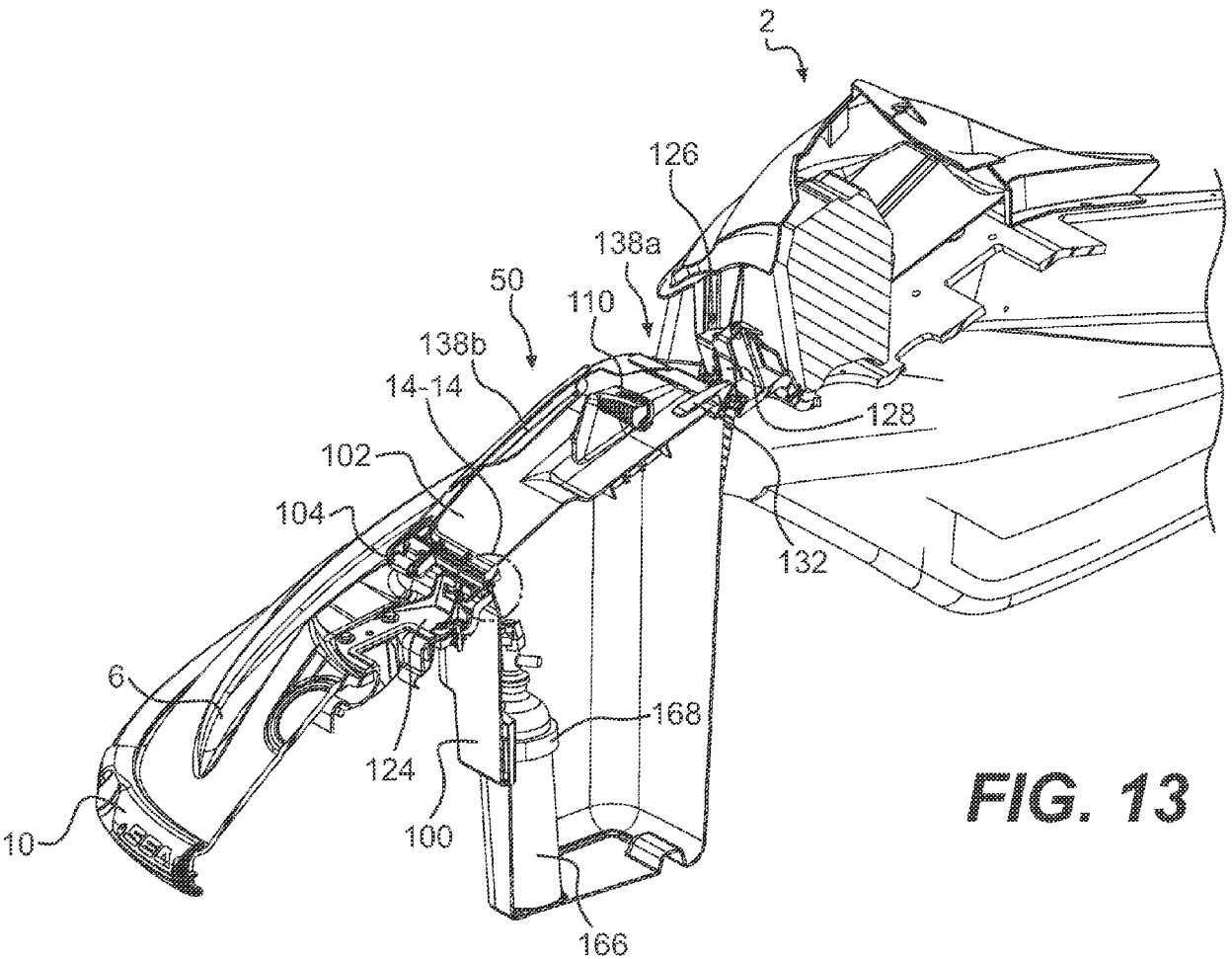
FIG. 13 is a cross-sectional view, taken from a front, left side, of the front portion of the personal watercraft of FIG. 11 with the hood removed for clarity.
Figure 14:
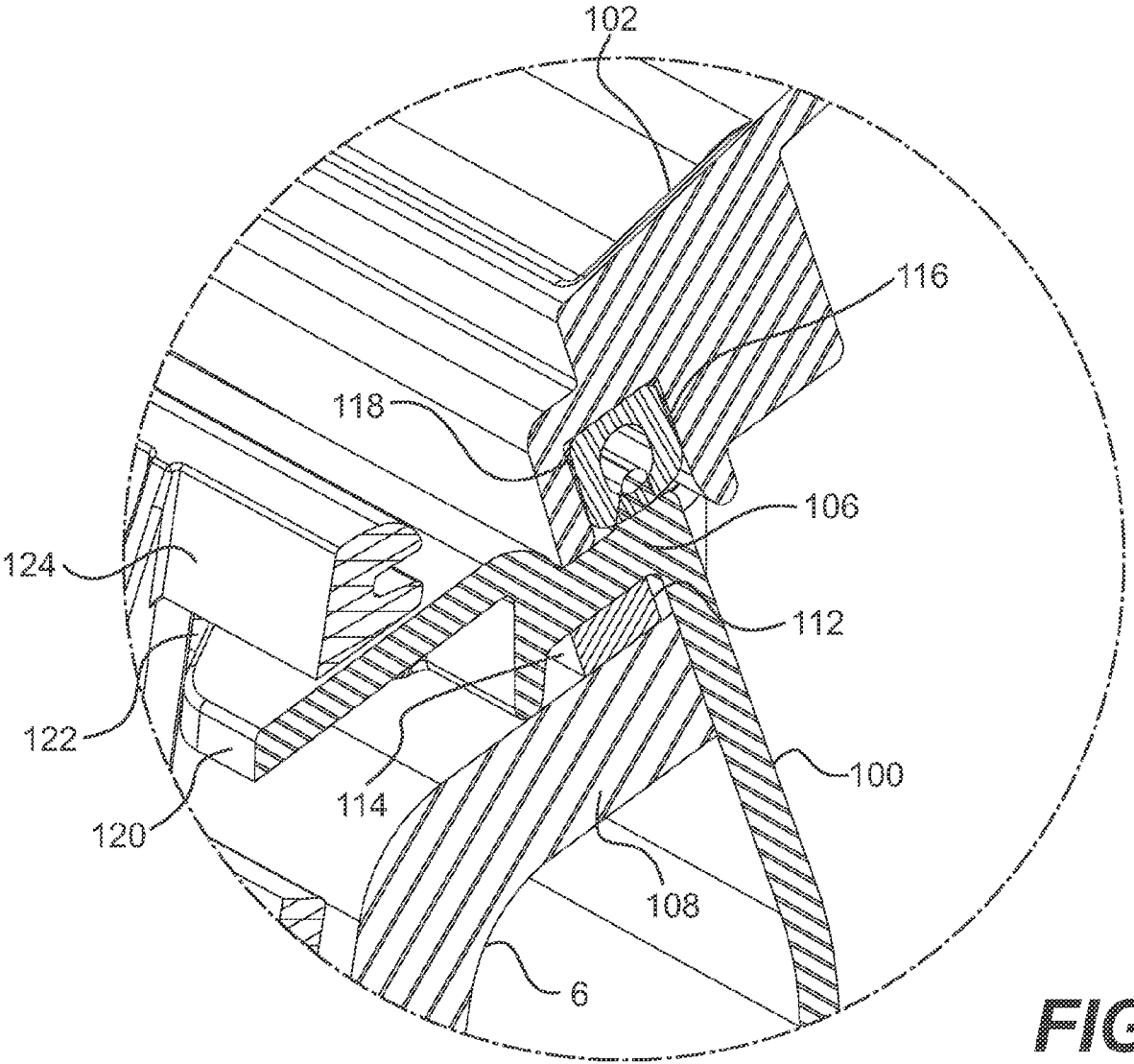
FIG. 14 is a close-up view of portion 14-14 of FIG. 13 showing the layout of the seals and the manner in which the storage bin in supported on the deck of the personal watercraft.
Figure 15:
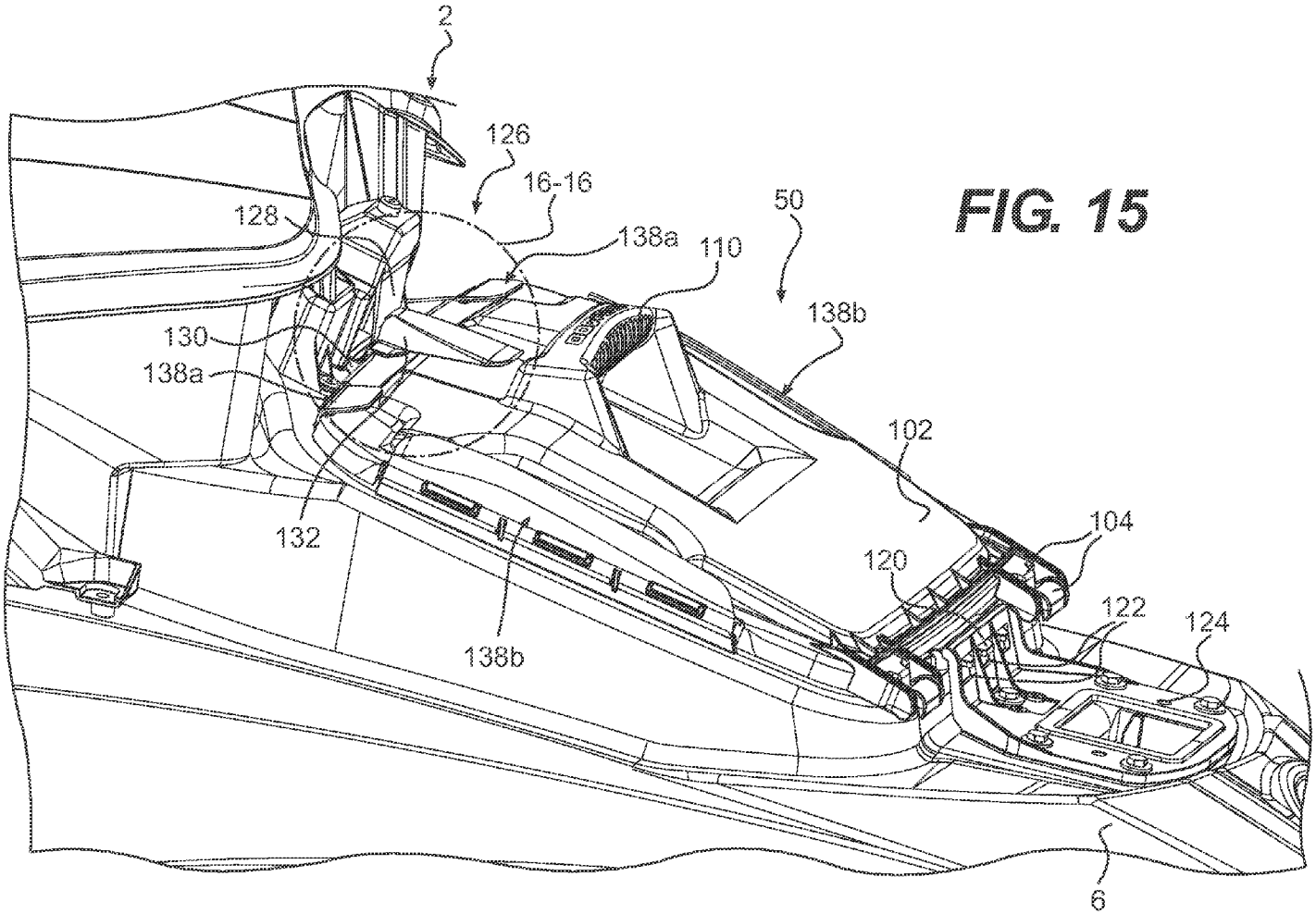
FIG. 15 is a perspective view, taken from a front, right side, of the front portion of the personal watercraft of FIG. 11 with the hood removed for clarity showing the storage bin latched to the deck.

The storage bin 50 is disposed under the hood 48 in an opening provided in the deck 6 forwardly of the steering handles 38. The storage bin 50 can be accessed by moving the hood 48 to an open position, as shown in FIG. 11. As best seen in FIG. 14, the container 100 has a lip 106 protruding from an upper end thereof which rests on a contour 108 of the opening. The upper edge of the container 100 is angled such that when the lip 106 rests on the contour 108, the bottom of the container 100 is generally horizontal. It is contemplated that the lip 106 could only be provided on a portion of the upper end of the container 100. The contour 108 is raised relative the portions of the deck 6 adjacent to it to help providing protection from water infiltration inside the engine compartment. When the hood 48 is opened, a handle 110 provided on the lid 102 allows the storage bin 50 to be easily removed from the opening, and therefore the watercraft 2, as shown in FIG. 12.

As seen in FIG. 14, a seal 112 is attached inside a groove 114 under the lip 106 around the periphery of the container 100. The seal 112 is pressed against the contour 108 when the storage bin 50 is disposed in the opening in the deck 6 to discourage water from entering the engine compartment by the opening. It is contemplated that the seal 112 could be attached to the contour 108 of the opening instead of to the lip 106, or any other suitable location for accomplishing its intended purpose. Another seal 116 is attached inside a groove 118 around the periphery of the lid 102. When the lid 102 is closed, the seal 116 is pressed against the top of the lip 106 of the container 100 to discourage water from entering the interior of the container 100, thus preventing items stored in the storage bin 50 from getting wet. It is contemplated that the seal 116 could be provided on the top of the lip 106 around a periphery thereof instead of on the lid 102. Thus, it is no longer necessary to provide seals between the hood 48 and the storage bin 50, as was the case in the prior art, since the lid 102, and seals 112 and 116 provide the necessary protection against water infiltration inside the container 100 and the engine compartment.

As best seen in FIGS. 14 to 17, the storage bin 50 is retained onto the deck 6 at the front and rear of the storage bin 50. At the front, a notched tongue 120 extends from the container 100. When the storage bin 50 is placed in the opening in the deck 6, the notched tongue 120 is slid into openings 122 located in the fixed portion 124 of the hinge 52 of the hood 48. This restricts vertical movement of the front portion of the storage bin 50.

Figure 16:
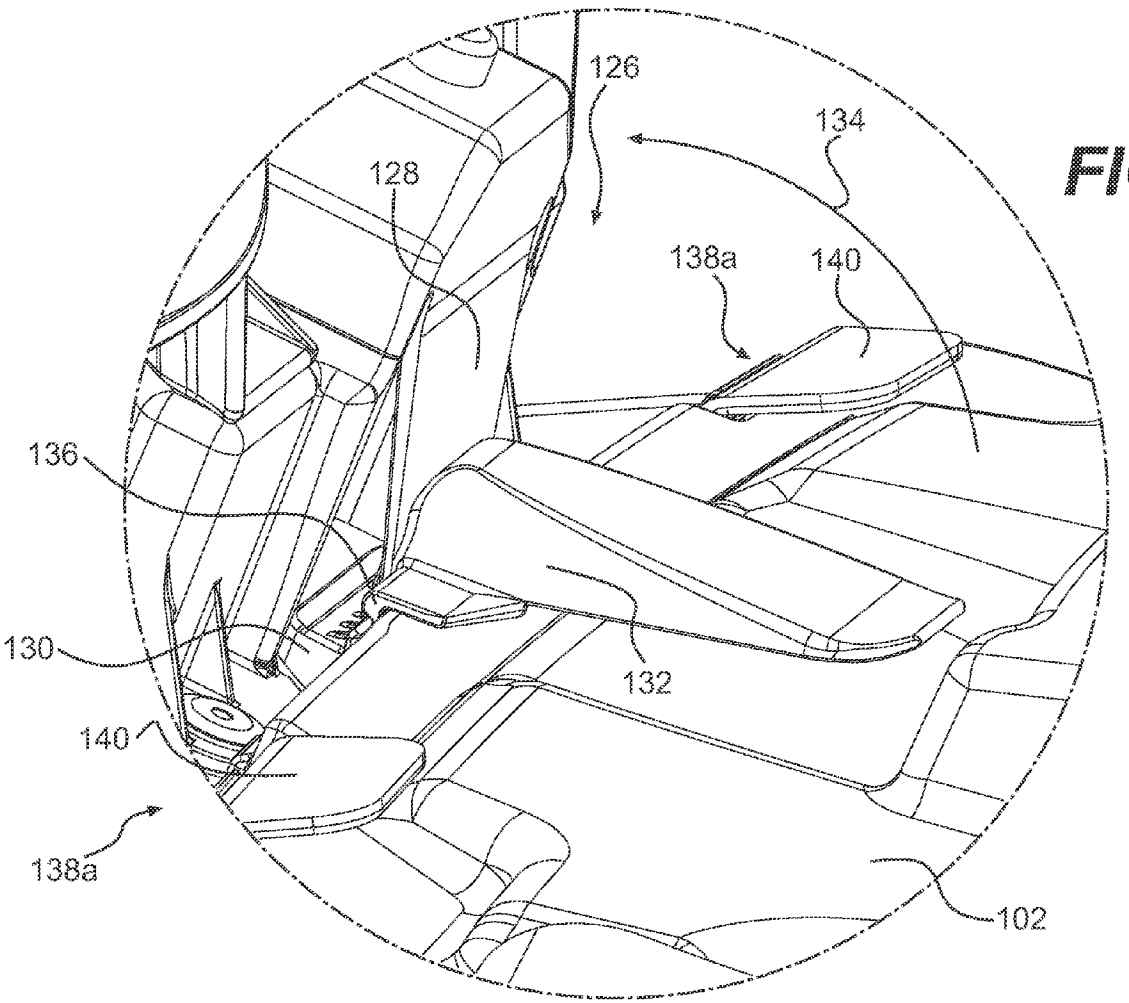
FIG. 16 is a close-up view of portion 16-16 of FIG. 15 showing the latch used to latch the storage bin.
Figure 17:
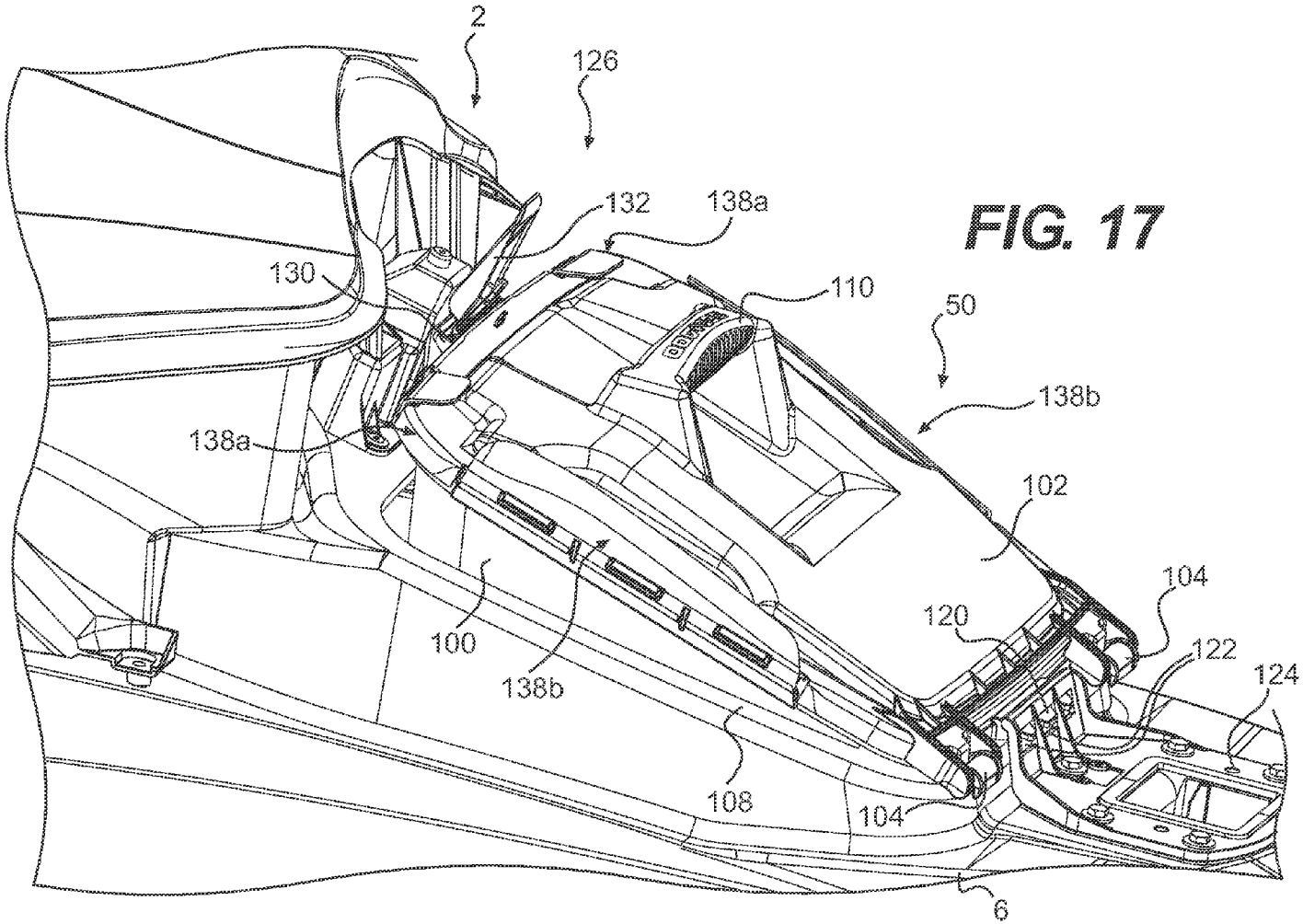
FIG. 17 is a perspective view, taken from a front, right side, of the front portion of the personal watercraft of FIG. 11 with the hood removed for clarity showing the storage bin unlatched and partially removed from the deck.
Figure 18:
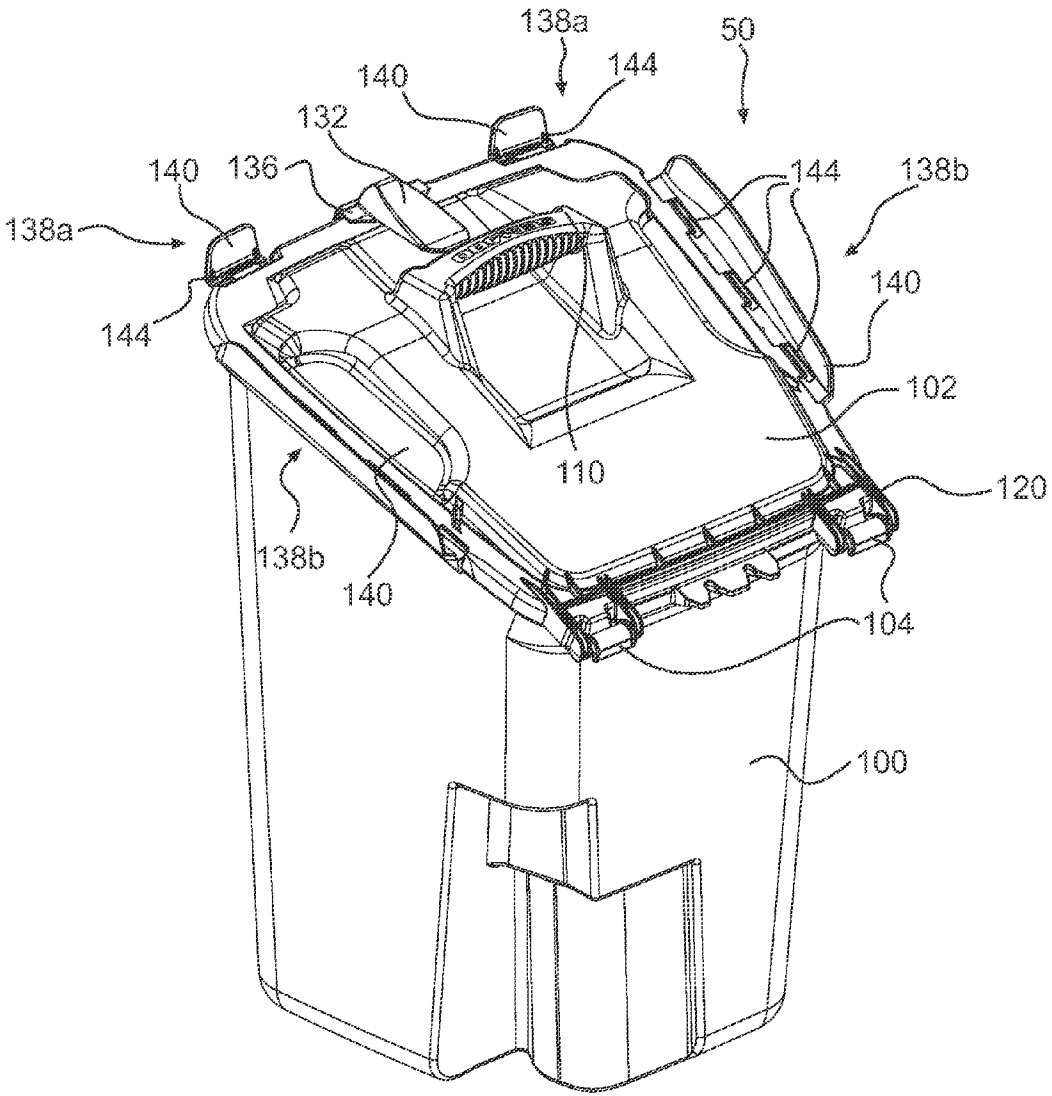
FIG. 18 is a perspective view, taken from a front, right side, of a personal watercraft storage bin in accordance with the present invention with the lid in a closed position.
Figure 19:
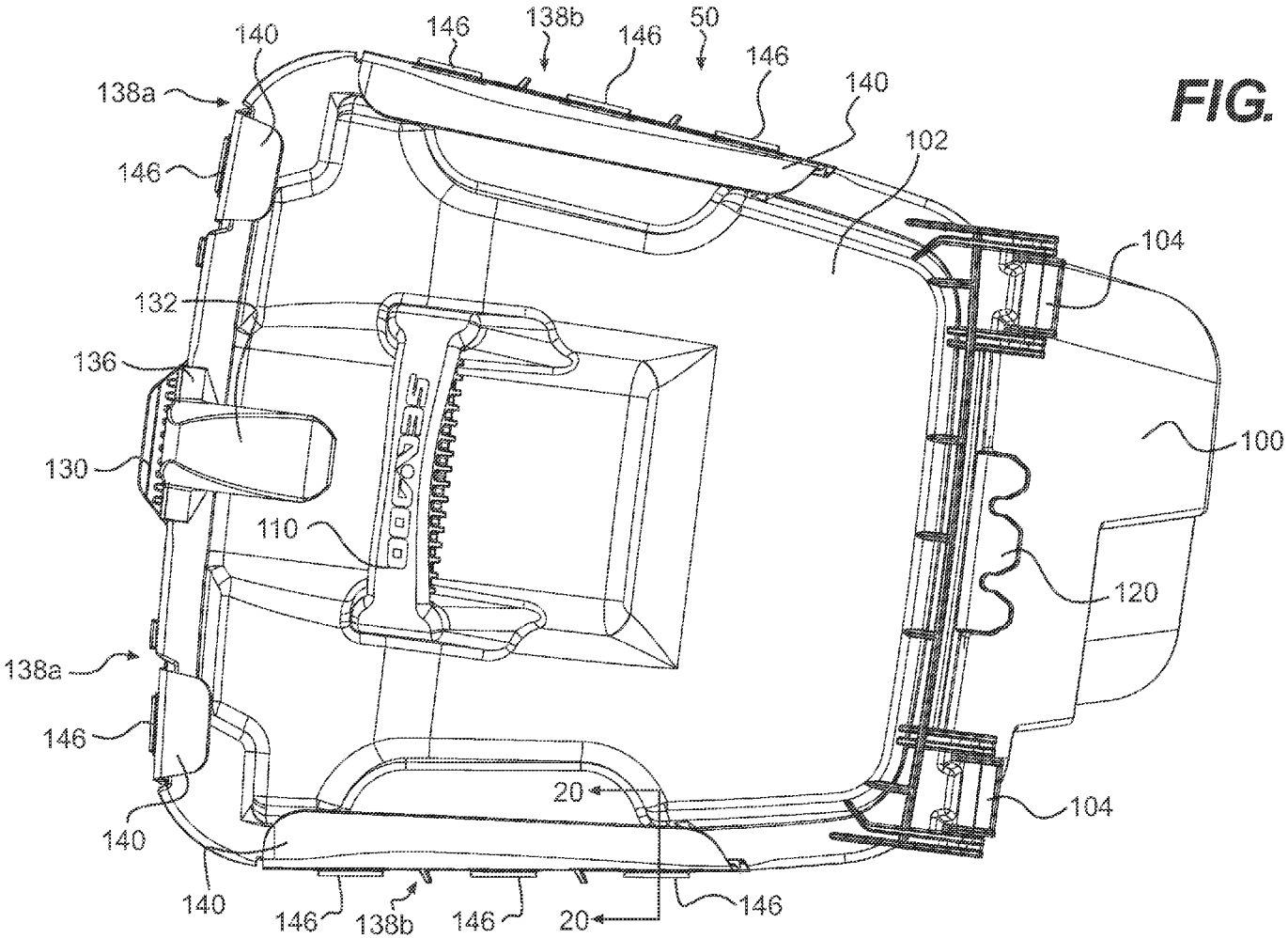
FIG. 19 is a perspective view, taken from a top, front side, of the personal watercraft storage bin of FIG. 18.

At the rear of the storage bin 50, a latch 126 holds the storage bin 50 in place. The latch 126 consists of a deformable retaining member 128, preferably made of plastic, attached to the deck 6 behind the opening, a tongue 130 extending from the back of the container 100, and a lever 132 hinged to the lid 102. As the storage bin 50 is placed in the opening in the deck 6, the tongue 130 pushes the deformable retaining member 128 towards the transom 60 of the watercraft 2. When the tongue 130 clears the end of the deformable retaining member 128, the deformable retaining member 128 springs back to its original position where it extends above the tongue 130, thus restricting vertical movement of the rear portion of the storage bin 50. To unlatch the rear portion of the storage bin 50, the lever 132 needs to be moved in the direction of arrow 134 (FIG. 16). When it is moved in this direction, the lever 132 pushes against the deformable retaining member 128 so that it no longer extends above the tongue 130. The storage bin 50 can then be removed from the opening in the deck 6, as shown in FIG. 17. The lever 132 is preferably hinged to the lid 102 by a living hinge 136, such that the lid 102, lever 132, and living hinge 136 are integrally formed and can be molded as a single part.

It is contemplated that the storage bin 50 could be retained on the deck 6 in other ways. The latch 126 could be located on the front of the storage bin 50 and the notched tongue 120 and openings 122 on the back of the storage bin. Other types of latches could be used. The storage bin 50 could be retained on its sides. The storage bin 50 could also be held in place with straps attached to the deck 6.

Turning now to FIGS. 18 to 23, additional features of the storage bin 50 will be described. Four locks 138 are provided on the storage bin 50 to lock the lid 102 in its closed position. Two locks 138*a* are provided on the back of the storage bin 50, and one lock 138*b* is provided on each of the two lateral sides of the storage bin 50. The locks 138 prevent the lid 102 from accidentally becoming opened when the storage bin 50 is carried by the handle 110. The locks 138, when locked, also compress the seal 116 between the lid 102 and the container 100, thus providing better sealing between the two parts.

Figure 20:
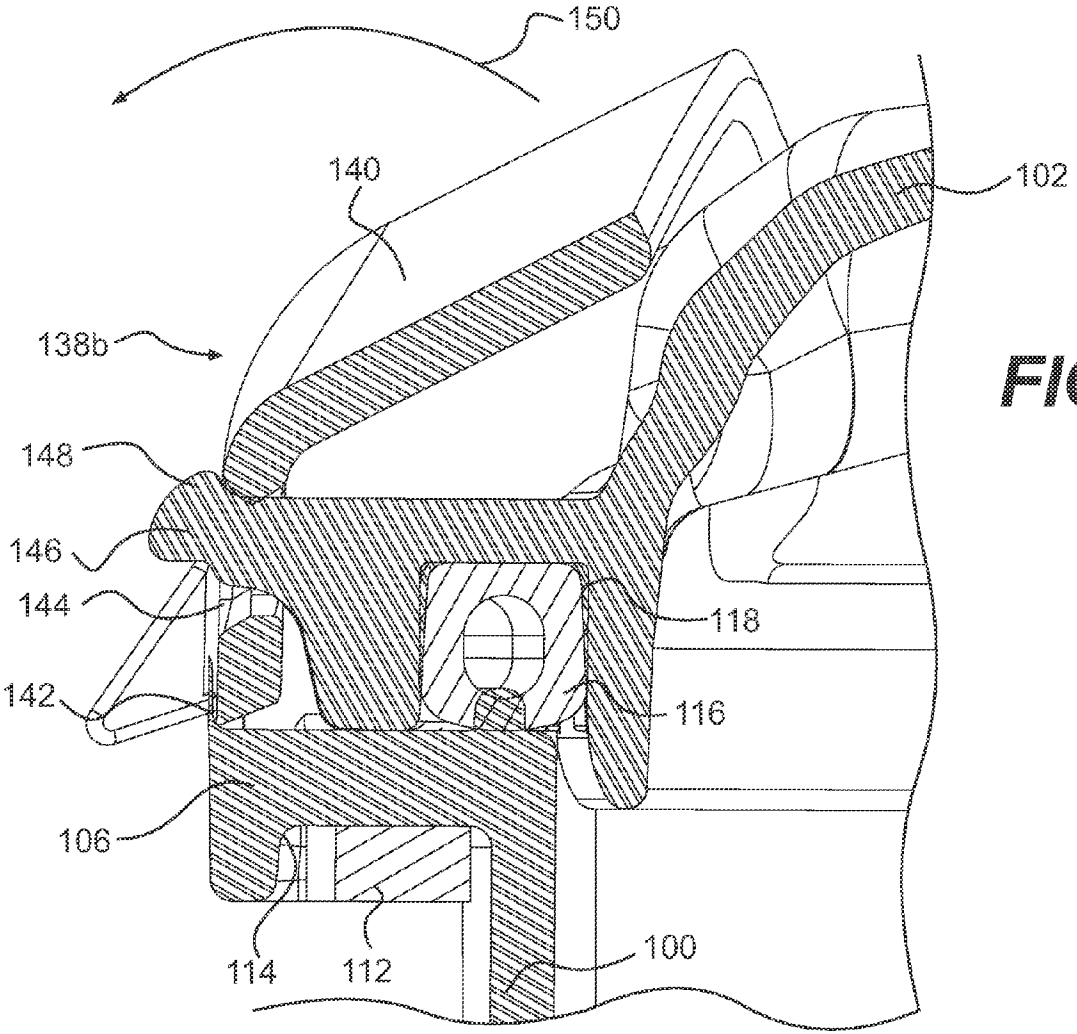
FIG. 20 is a close-up view of section 20-20 of FIG. 19 showing details of one of the locks of the personal watercraft storage bin of FIG. 18.

Each of the locks 138 has a hinged portion 140 hinged to the container 100 via a living hinge 142 (see FIG. 20). Each hinged portion 140 is provided with one or more openings 144 therein. The locks 138*a* each have one opening 144. The locks 138*b* each have three opening 144. The lid 102 is provided with a number of tongues 146 extending therefrom. One tongue 146 is provided in alignment with each of the openings 144. When a lock 138 is in its locked position, as shown in FIG. 20, the corresponding tongue 146 extends in the opening 144 of the hinged portion 140, thus preventing the lid 102 to be moved to its open position. A protrusion 148 (FIG. 20) on each tongue 146 keeps the lock 138 in it locked position and prevents the lock 138 from easily becoming unlocked. To unlock a lock 138, the hinged portion 140 is moved in the direction of arrow 150 until the tongue 146 no longer extends in the opening 144. It is contemplated that more or less locks could be used. It is also contemplated that other types of locks could be used. For example, a key lock could be used to allow for secure storage of items inside the storage bin 50.

Figure 21:
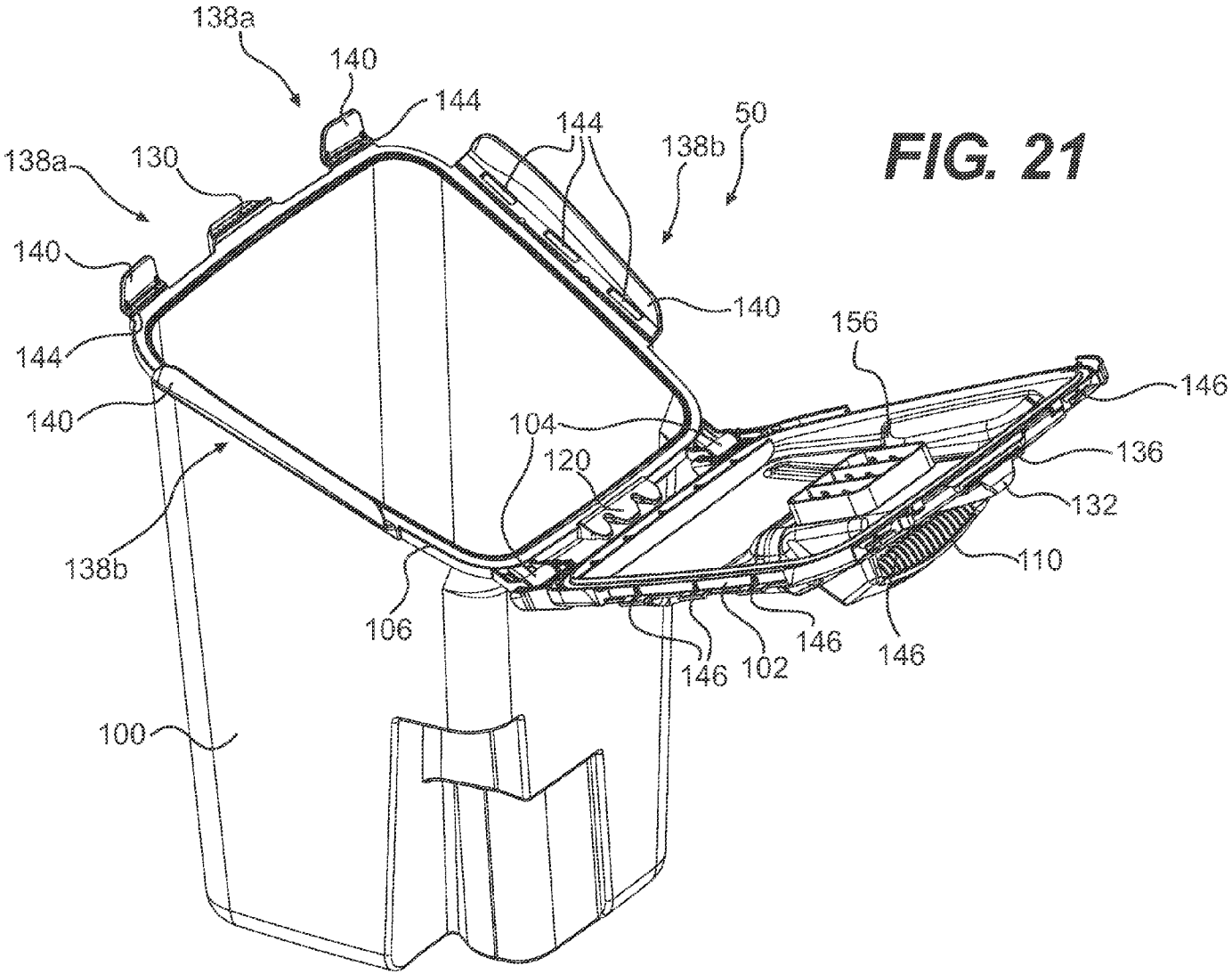
FIG. 21 is a perspective view, taken from a front, right side, of the personal watercraft storage bin of FIG. 18 with the lid in an open position.
Figure 22:
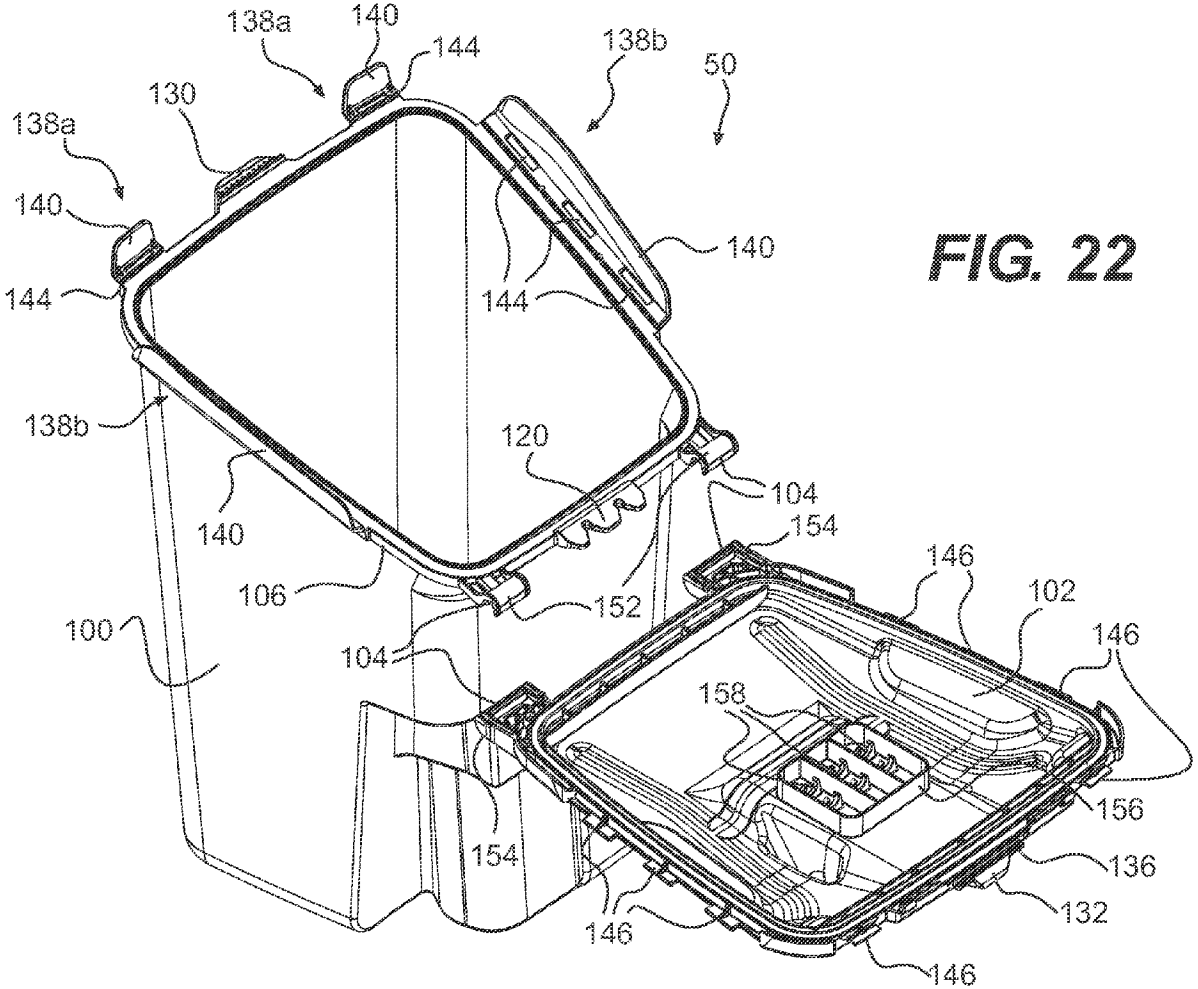
FIG. 22 is a perspective view, taken from a front, right side, of the personal watercraft storage bin of FIG. 18 with the lid separated from the container.

As best seen in FIG. 22, each of the hinges 104 is made of two parts. A first part, in the form of a hook 152, is attached to the container 100. A second part, in the form of a pin 154, is attached to the lid 102. The pin 154 rotates inside the hook 152 which allows the lid 102 to be moved between an open position, shown in FIG. 21, providing access to an interior of the container 100 and a closed position, shown in FIG. 18, preventing access to the interior of the container 100. Since the hook 152 is opened towards the bottom, the lid 102 can be detached from the container 100 by rotating the lid 102 to the position shown in FIG. 22. This also allows the lid 102 and the container 100 to be easily assembled together.

As seen in FIGS. 21 and 22, a spark plug support 156 is disposed on a side of the lid 102 facing an interior of the container 100 when the lid 102 is closed. The spark plug support 156 allows spare spark plugs (not shown) to be stocked aboard the watercraft 2 in a dry location. The spark plugs are clipped in clips 158 (two clips 158 per spark plug) of the spark plug support 156. The spark plug support 156 illustrated allows three spark plugs to be stocked.

Figure 23:
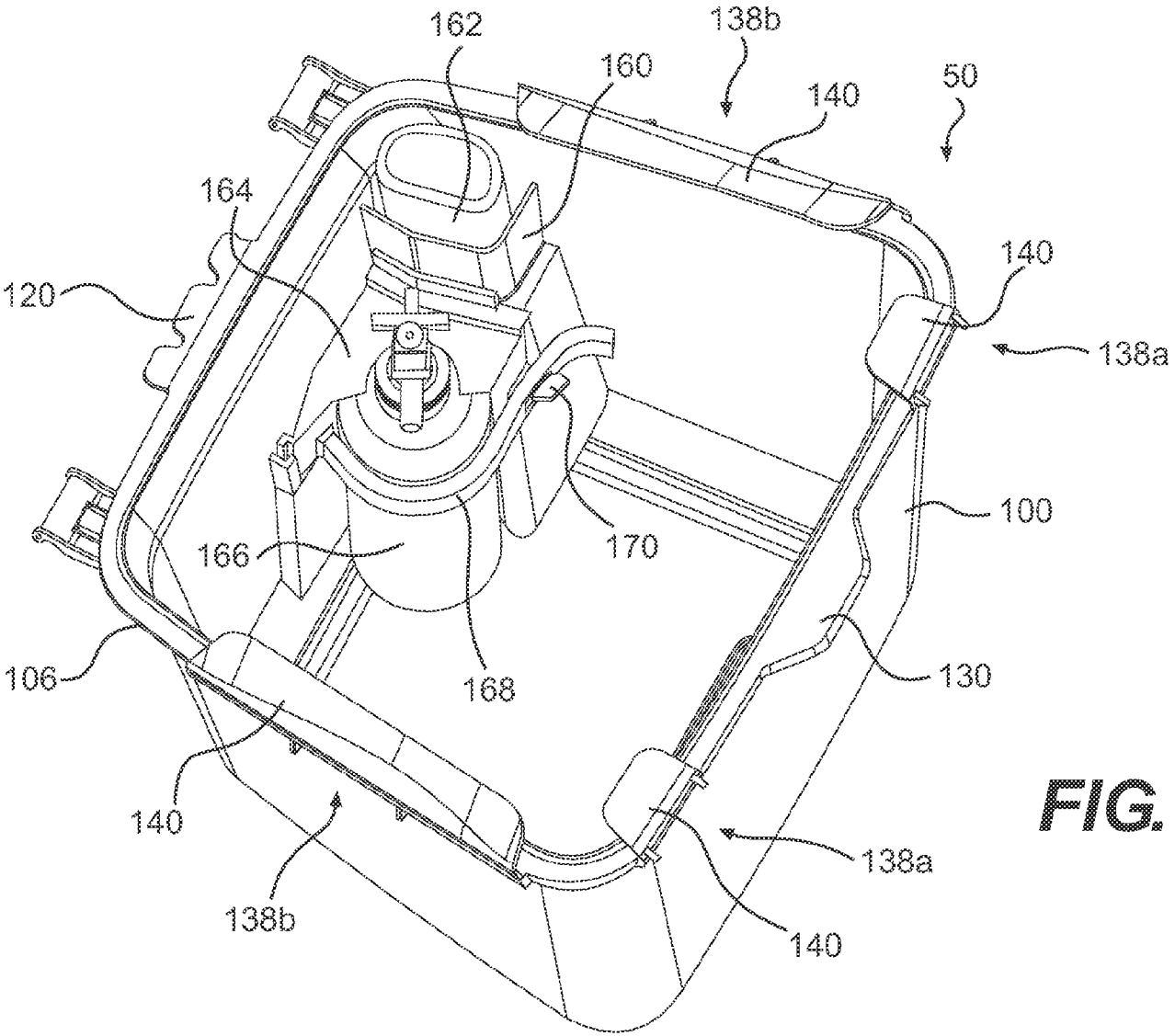
FIG. 23 is a top perspective view, taken from a rear, left side, of the personal watercraft storage bin of FIG. 18 with the lid removed from the container and showing some of the internal features of the container.

Turning now to FIG. 23, a receptacle 160 is formed in the interior of the container 100 to receive a tool box 162. A bracket 164 is shaped to receive a fire extinguisher 166. The fire extinguisher 166 is held in place by an elastic strap 168 which is removably attached to a tab 170 on the bracket 164. It is contemplated that additional receptacles, brackets, and/or straps could be provided inside the container to accommodate other specific items which could be stored in the storage bin 50.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A personal watercraft comprising:

a hull;

a deck disposed on the hull, the hull and the deck defining an engine compartment;

a propulsion system connected to the hull for propelling the watercraft;

an engine disposed in the engine compartment for powering the propulsion system;

steering handles disposed on the deck for steering the watercraft;

an opening provided in the deck forwardly of the steering handles, the opening having a contour;

a storage bin disposed in the opening, the storage bin being removable from the opening, the storage bin comprising:

a container disposed in the opening;

a lid operatively connected to the container and being movable between an open position providing access to an interior of the container and a closed position preventing access to the interior of the container; and at least one lock having at least a portion disposed on the container for locking the lid in the closed position; and a hood operatively connected to the deck and being movable between an open position providing access to the storage bin and a closed position preventing access to the storage bin.

2. The personal watercraft of claim 1, further comprising a seat disposed on the deck.

3. The personal watercraft of claim 1, wherein the lid is hinged to the container.

4. The personal watercraft of claim 1, wherein the storage bin further comprises a handle disposed on the lid.

5. The personal watercraft of claim 1, wherein the storage bin is latched to the deck.

6. The personal watercraft of claim 1, wherein the container has a lip, and the lip rests on the contour of the opening.

7. The personal watercraft of claim 6, wherein the contour of the opening is raised relative to portions of the deck adjacent to the contour.

8. The personal watercraft of claim 6, further comprising a first seal disposed between the container and the contour of the opening.

9. The personal watercraft of claim 8, wherein the first seal is attached to the lip.

10. The personal watercraft of claim 9, further comprising a second seal disposed between the lip and the lid when the lid is in the closed position.

11. The personal watercraft of claim 1, further comprising a seal disposed between the container and the lid when the lid is in the closed position.

12. The personal watercraft of claim 1, wherein the hood is hinged to the deck.

13. A storage bin for a personal watercraft comprising:

a container having a plurality of sides, a bottom, and an open end opposite the bottom;

a lip extending outwardly from at least a portion of the sides, the lip being disposed near the open end;

a first seal attached to the lip, the first seal being disposed under the lip;

a lid operatively connected to the container, the lid being movable between an open position providing access to an interior of the container via the open end and a closed position preventing access to the interior of the container, the lid having at least one tongue extending therefrom;

a second seal disposed between the lip and the lid when the lid is in the closed position; and at least one lock for locking the lid in the closed position, the at least one lock having a hinged portion having an opening therein, the hinged portion being movable between a locked position and an unlocked position, such that when the hinged portion is in the locked position, the at least one tongue extends inside the opening of the hinged portion to prevent the lid from being moved to the open position.

14. The storage bin of claim 13, wherein the lid is hinged to the container.

15. The storage bin of claim 13, further comprising a handle disposed on the lid.

16. The storage bin of claim 13, wherein the second seal is attached to the lid.

17. The storage bin of claim 13, wherein the hinged portion of the at least one lock is hinged to the lip via a living hinge.

18. The storage bin of claim 13, further comprising a spark plug support disposed on a side of the lid facing the interior of the container when the lid is in the closed position.

19. The storage bin of claim 13, further comprising a receptacle disposed inside the container.

20. The personal watercraft of claim 1, further comprising a latch located on the hood for locking the hood in the closed position.

21. A storage bin for a personal watercraft comprising:

a container having four sides, a bottom, and an open end opposite the bottom;

a lip extending outwardly from at least a portion of the sides, the lip being disposed near the open end;

a first seal attached to the lip, the first seal being disposed under the lip;

a lid hinged to one side of the container, the lid being movable between an open position providing access to an interior of the container via the open end and a closed position preventing access to the interior of the container;

a second seal disposed between the lip and the lid when the lid is in the closed position; and four locks for locking the lid in the closed position, two of the locks being disposed on a side of the container opposite the side to which the lid is hinged, and one of the locks being disposed on each of the remaining two sides.

22. The storage bin of claim 21, further comprising a handle disposed on the lid.

23. The storage bin of claim 21, wherein the second seal is attached to the lid.

24. The storage bin of claim 21, further comprising a spark plug support disposed on a side of the lid facing the interior of the container when the lid is in the closed position.

25. The storage bin of claim 21, further comprising a receptacle disposed inside the container.

* * * * *